US006886607B2

(12) United States Patent
Takano

(10) Patent No.: US 6,886,607 B2
(45) Date of Patent: May 3, 2005

(54) FUNCTION LIQUID FILLING APPARATUS, LIQUID DROPLET EJECTION APPARATUS EQUIPPED WITH THE SAME, METHOD OF MANUFACTURING ELECTRO-OPTICAL DEVICE, ELECTRO-OPTICAL DEVICE, AND ELECTRONIC EQUIPMENT

(75) Inventor: Yutaka Takano, Asahi-mura (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 10/792,660

(22) Filed: Mar. 3, 2004

(65) Prior Publication Data

US 2004/0250874 A1 Dec. 16, 2004

(30) Foreign Application Priority Data

Mar. 5, 2003 (JP) ..... 2003-058852

(51) Int. Cl.[7] ..... B65B 1/04
(52) U.S. Cl. ..... 141/83; 141/192
(58) Field of Search ..... 141/2, 18, 83, 141/192; 340/615, 618

(56) References Cited

U.S. PATENT DOCUMENTS 5,996,650 A * 12/1999 Phallen et al. ..... 141/83
6,167,747 B1 * 1/2001 Koch et al. ..... 73/19.03

FOREIGN PATENT DOCUMENTS

JP 6-99592 4/1994

OTHER PUBLICATIONS

Patent Abstracts of Japan regarding Publication No. 05–099592, published Apr. 12, 1994.

* cited by examiner

*Primary Examiner*—Gregory L. Huson
*Assistant Examiner*—Peter deVore
(74) *Attorney, Agent, or Firm*—Harness, Dickey & Pierce, P.L.C.

(57) ABSTRACT

A function liquid filling device includes: a feed unit for feeding a function liquid in a function liquid tank toward head caps coupled to function liquid droplet ejection heads through the function liquid droplet ejection heads; a detection unit for detecting that the fed function liquid reaches the head caps; and a control unit for stopping the drive of the feed unit based on a result of detection by the detection unit. The detection unit includes: a crystal oscillator disposed in the head cap and/or a waste liquid passage; and a detector for detecting the presence or absence of the function liquid based on a change in a resonance frequency of the crystal oscillator.

20 Claims, 17 Drawing Sheets

FUNCTION LIQUID FILLING APPARATUS, LIQUID DROPLET EJECTION APPARATUS EQUIPPED WITH THE SAME, METHOD OF MANUFACTURING ELECTRO-OPTICAL DEVICE, ELECTRO-OPTICAL DEVICE, AND ELECTRONIC EQUIPMENT

CROSS-REFERENCE TO RELATED APPLICATIONS

This application claims priority to Japanese Patent Application No. 2003-058852, filed Mar. 5, 2003 which is hereby expressly incorporated by reference herein in its entirety.

BACKGROUND OF THE INVENTION

1. Field of the Invention

This invention relates to a function liquid filling apparatus which fills passages inside a function liquid droplet ejection head with a function liquid contained in a function liquid tank by feeding the function liquid into a head cap side through the function liquid droplet ejection head. This invention also relates to a liquid droplet ejection apparatus equipped with the function liquid filling apparatus; a method of manufacturing an electro-optical device; an electro-optical device; and an electronic equipment.

2. Description of the Related Art

An ink jet head (function liquid droplet ejection head) of an ink jet printer (liquid droplet ejection apparatus) can accurately eject minute ink droplets (liquid droplets) in a dot shape. Thus, the ink jet head is expected to be applied to the field of manufacturing various products. There has been considered a liquid droplet ejection apparatus which introduces a function liquid, such as a particular link and a photosensitive resin liquid, into a function liquid droplet ejection head and accurately ejects the function liquid to a workpiece such as a substrate. In an initial stage of installation of a new apparatus or in the case of introducing a new function liquid droplet ejection head, passages inside the function liquid droplet ejection head are filled with a function liquid by using the following methods, i.e.: a method of driving suction means (a suction pump) which is connected to a head cap by connecting the head cap to the function liquid droplet ejection head; a method of driving pressurization feed means which is connected to a function liquid tank; and the like.

For example, in the method using the suction pump, the suction pump is driven to suck the function liquid from the function liquid tank through the function liquid droplet ejection head and the head cap. Thereafter, the function liquid is detected by detection means provided near a downstream side of the head cap, and the suction pump is stopped. In this case, as the detection means, there has been known one which detects the function liquid passing through transparent ducts, which are arranged in the downstream of the head cap, from the outside by using photosensors provided in the middle of the transparent ducts.

However, in an example in which an optical detection means such as the photosensor is used, malfunction is likely to occur when a dried function liquid is stuck to an inner surface of a pipe or passage of a member transmitting light or when dust and the like are adhered to an external surface of the pipeline or passage. Consequently, there arises a problem in that reliability of detection is deteriorated.

SUMMARY OF THE INVENTION

It is an advantage of this invention to provide a function liquid filling device capable of accurately filling passages inside a function liquid droplet ejection head with a function liquid by allowing a detector of detection means to come into direct contact with the function liquid. It is another advantage of this invention to provide: a liquid droplet ejection apparatus equipped with the function liquid filling device; a method of manufacturing an electro-optical device; an electro-optical device; and electronic equipment.

According to this invention, there is provided a function liquid filling apparatus which fills a passage inside a function liquid droplet ejection head connected to a function liquid tank with a function liquid in the function liquid tank by coupling a head cap connected to a waste liquid passage to the function liquid droplet ejection head, thereby feeding the function liquid toward the head cap through the function liquid droplet ejection head. The apparatus comprises: feed means for feeding the function liquid in the function liquid tank toward the head cap through the function liquid droplet ejection head; detection means for detecting a state in that the fed function liquid reaches the head cap; and control means for stopping drive of the feed means based on a result of detection by the detection means, wherein the detection means comprises a crystal oscillator disposed inside the head cap and/or inside the waste liquid passage, and a detector for detecting presence or absence of the function liquid based on a change in a resonance frequency of the crystal oscillator.

According to this arrangement, when feeding of the function liquid is started by the feed means, the function liquid inside the function liquid tank flows toward the head cap through the function liquid droplet ejection head and the passage inside the function liquid droplet ejection head is filled with the function liquid. When the fed function liquid reaches the head cap and the crystal oscillator of the detection means, which is disposed inside the head cap and/or inside the waste liquid passage, comes into contact with the function liquid, the detector of the detection means detects the presence of the function liquid based on the change in the resonance frequency of the crystal oscillator. Thereafter, based on this detection result, the control means stops the drive of the feed means. In such a manner, the crystal oscillator disposed inside the head cap and/or inside the waste liquid passage detects the state in that the function liquid reaches the head cap. Thus, no function liquid is wastefully consumed. Moreover, the crystal oscillator and the function liquid come into direct contact with each other inside the head cap and/or inside the waste liquid passage. Thus, the detection result is not influenced by the dried function liquid adhered to an inner surface of a member transmitting light as in the case of a conventional optical detection means. Accordingly, it is possible to accurately detect the state in that the function liquid reaches the head cap.

Preferably, the control means stops the drive of said feed means when a "detected" signal (i.e., a signal showing a state of "detected") of said detector lasts for a predetermined period of time after a detection operation by said detection means is started.

Further, preferably, the control means includes delay means for delaying output of a stop signal which stops the drive of the feed means for a predetermined period of time.

According to the above arrangements, even if the function liquid that has reached the head cap includes bubbles, a control operation is started to stop the drive of the feed means after enough time to discharge the bubbles from the passage inside the head has passed. Thus, bubbles inside the passage of the function liquid from the function liquid tank to the function liquid droplet ejection head can be surely discharged from the passage inside the head.

Preferably, the control means includes annunciation means for making an annunciation when a "detected" signal of the detector fails to continue for a predetermined period of time after a detection operation by the detection means is started.

According to the above arrangement, when the "detected" signal of the detector is not continued for the predetermined period of time, it is possible to determine that the discharge of the bubbles is insufficient due to some reasons. Thus, an operator is informed of errors and alerted.

Preferably, the feed means is pressurization feed means which is connected to the function liquid tank and which feeds the function liquid in the function liquid tank by pressurization.

According to the above arrangement, the function liquid tank connected to the function liquid droplet ejection head is pressurized by the pressurization feed means. Thus, the passage inside the function liquid droplet ejection head can be filled with the function liquid.

Preferably, the feed means is suction means for sucking the function liquid in the function liquid tank through the waste liquid passage.

According to the above arrangement, the function liquid is sucked from the function liquid tank through the head cap by the suction means. Thus, the passage inside the function liquid droplet ejection head can be filled with the function liquid.

According to another aspect of this invention, there is provided a function liquid filling apparatus which fills a plurality of passages inside a plurality of function liquid droplet ejection heads each being respectively connected to a function liquid tank through a plurality of supply passages, with a function liquid in the function liquid tank by coupling a plurality of head caps each being respectively connected to a plurality of waste liquid passages to the function liquid droplet ejection heads, thereby feeding the function liquid toward the plurality of head caps through the plurality of function liquid droplet ejection heads. The apparatus comprises: pressurization feed means which is connected to the function liquid tank and which feeds under pressure the function liquid in the function liquid tank; a plurality of passage blocking means each being respectively interposed in the plurality of supply passages; a plurality of detection means for respectively detecting a state in that the fed function liquid reaches the plurality of head caps; and control means for causing the passage blocking means corresponding to the head caps to which the function liquid has reached, to perform blocking operation in an order of reaching of the function liquid, based on a result of detection by the plurality of detection means, wherein each of the detection means comprises a crystal oscillator disposed in inside the head cap and/or inside the waste liquid passage duct, and a detector for detecting the presence of the function liquid based on a change in a resonance frequency of the crystal oscillator.

According to still another aspect of this invention, there is provided function liquid filling apparatus which fills passages in a plurality of function liquid droplet ejection heads connected to a function liquid tank through a plurality of supply passages, with a function liquid in the function liquid tank by coupling a plurality of head caps each being respectively connected to a plurality of waste liquid passages to the function liquid droplet ejection heads and by sucking the function liquid toward the plurality of head caps through the plurality of function liquid droplet ejection heads. The apparatus comprises: suction means for sucking the function liquid in the function liquid tank through the waste liquid passages; a plurality of passage blocking means each being interposed in the plurality of waste liquid passages; a plurality of detection means for detecting a state in that the fed function liquid reaches the plurality of head caps; and control means for causing the passage blocking means corresponding to the head caps to which the function liquid has reached, to perform blocking operation in an order of reaching of the function liquid, based on a result of detection by the plurality of detection means, wherein each of the detection means comprises a crystal oscillator disposed inside the head cap and/or inside the waste liquid passage, and a detector for detecting the presence or absence of the function liquid based on a change in a resonance frequency of the crystal oscillator.

According to the above arrangements, the control means allows the duct blocking means corresponding to the head caps to perform the blocking operation in the order from the head cap reached by the function liquid, based on the detection results of the plurality of detection means. Thus, even if single pressurization feed means or single suction means is used, for example, the passages in the respective function liquid droplet ejection heads can be accurately filled with the function liquid. Moreover, function liquid is not uselessly consumed. In this case, the crystal oscillator disposed inside the head cap and/or inside the waste liquid passage and the function liquid come into direct contact with each other. Thus, the detection result is not influenced by the dried function liquid adhered to an inner surface of a member transmitting light such as optical detection means. Accordingly, it is possible to accurately detect, for each of the caps, the state in that the function liquid reaches the head cap.

Preferably, the control means causes each of the duct blocking means to perform the blocking operation when a "detected" signal by the detector continues for a predetermined period of time after a detection operation by each of the detection means is started.

Preferably, the control means comprises delay means for delaying, for a predetermined period of time, output of a blocking signal which allows each of said duct blocking means to perform the blocking operation.

According to the above arrangements, at the stage where the "detected" signal of the detector is intermittently outputted due to the existence of bubbles, the duct blocking means does not perform the blocking operation. In other words, after enough time to discharge the bubbles from the passages inside the functional liquid ejection head has passed, the control operation is started to allow the duct blocking means to perform the blocking operation. Thus, the bubbles can be surely discharged from the passages inside the head.

Preferably, control means comprises annunciation means for making an annunciation when a "detected" signal of the detector fails to continue for a predetermined period of time after a detection operation by the detection means is started.

According to the above arrangement, in case where the function liquid does not reach the head cap even when a predetermined period of time has passed after the detection operation by the detection means is started, some kind of errors are considered to have occurred. Thus, the annunciation means informs to that effect.

Preferably, the function liquid filling apparatus further comprises cleaning liquid supply means which is connected to the function liquid tank and which cleans all flow passages of the function liquid by feeding a cleaning liquid to all the flow passages from the function liquid tank to the waste liquid passages.

According to the above arrangement, in replacement of the function liquid droplet ejection head or in replacement of the function liquid, the cleaning liquid supply means can clean all the passages of the function liquid from the function tank to the waste liquid passages by feeding the cleaning liquid thereto. Thus, not only adhesion and the like of the function liquid to all the passages described above can be prevented but also the crystal oscillator making direct contact with the function liquid can be cleaned accordingly. Consequently, wrong detections can be prevented.

The liquid droplet ejection apparatus according to this invention includes: the function liquid filling apparatus as described above; and a drawing device which forms a film formation part formed with the function liquid on a workpiece by ejecting the function liquid droplet while making a relative movement between the function liquid droplet ejection head and the workpiece.

According to the above arrangement, passages in the function liquid droplet ejection heads can be properly filled with the function liquid. In addition, since the liquid droplet ejection apparatus includes the function liquid filling device capable of reducing the function liquid consumed in filling thereof, running costs of the liquid droplet ejection apparatus can be reduced.

A method of manufacturing an electro-optical device according to this invention comprises forming a film formation part on a workpiece with the function liquid droplet by means of the function liquid droplet ejection apparatus as described above.

Moreover, an electro-optical device according to this invention is formed on a workpiece with a function liquid droplet by means of the function liquid droplet ejection apparatus as described above.

According to the above arrangement, the electro-optical device is manufactured by using the liquid droplet ejection apparatus capable of a variety of ejections of the function liquid on the workpiece. Thus, the electro-optical device itself can be efficiently manufactured. As the electro-optical device, a liquid crystal display device, an organic EL (electro-luminescence) device, an electron-emitting device, a plasma display panel (PDP) device, an electrophoretic display and the like are conceivable. Herein the electron-emitting device conceptually includes a so-called field emission display (FED) device. Furthermore, as the electro-optical device, conceivable are devices for forming a metallic wiring, a lens, a resist, a light diffusion body and the like.

An electronic equipment according to this invention is manufactured by the method of manufacturing the electro-optical device as described above. An electronic equipment according to this invention has mounted thereon the electro-optical device as described above.

In this case, as the electronic equipment, a portable telephone equipped with a so-called flat panel display, a personal computer and various other electrical appliances are applicable.

BRIEF DESCRIPTION OF THE DRAWINGS

The above and other objects and the attendant features of this invention will become readily apparent by reference to the following detailed description when considered in conjunction with the accompanying drawings wherein.

DETAILED DESCRIPTION OF THE PREFERRED EMBODIMENTS

Figure 1:
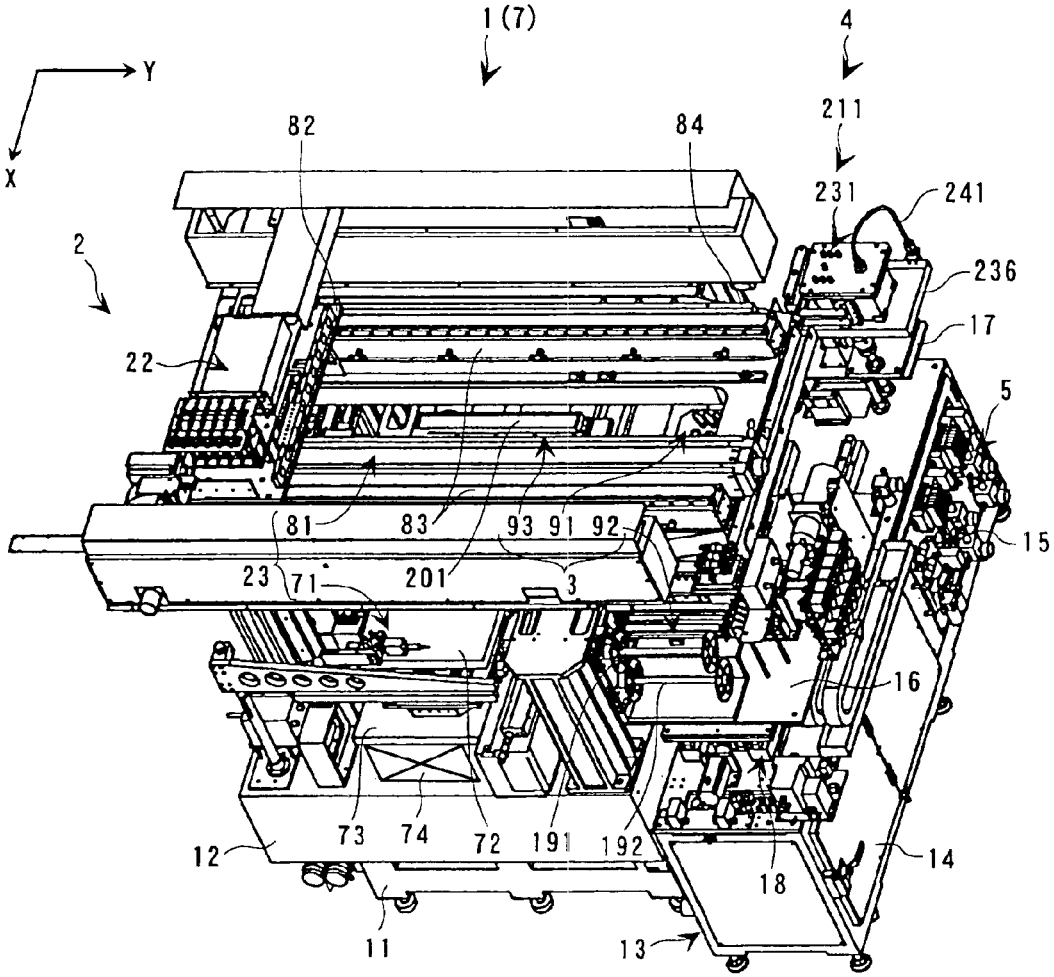
FIG. 1 is an external perspective view of a liquid droplet ejection apparatus according to an embodiment of this invention.
Figure 2:
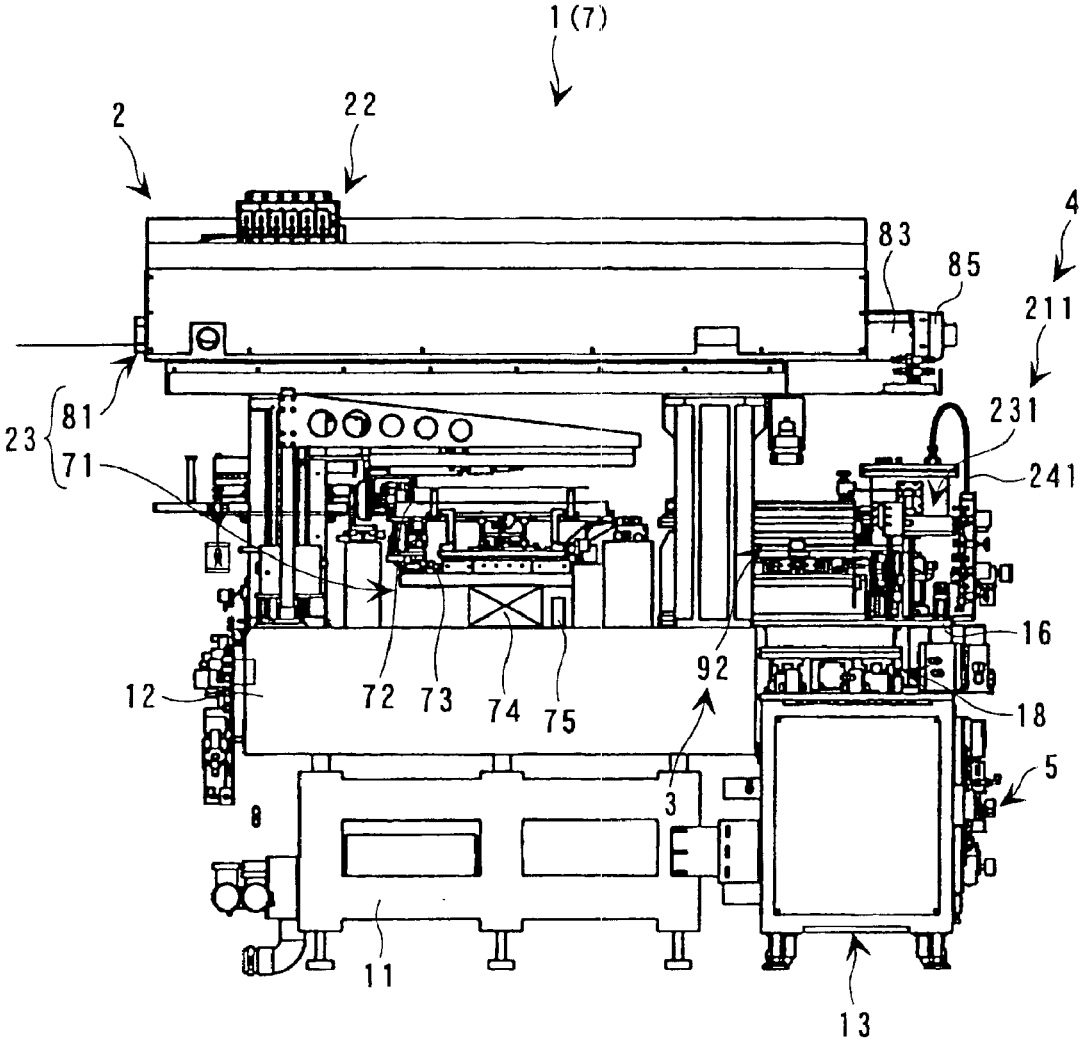
FIG. 2 is a front view thereof.
Figure 3:
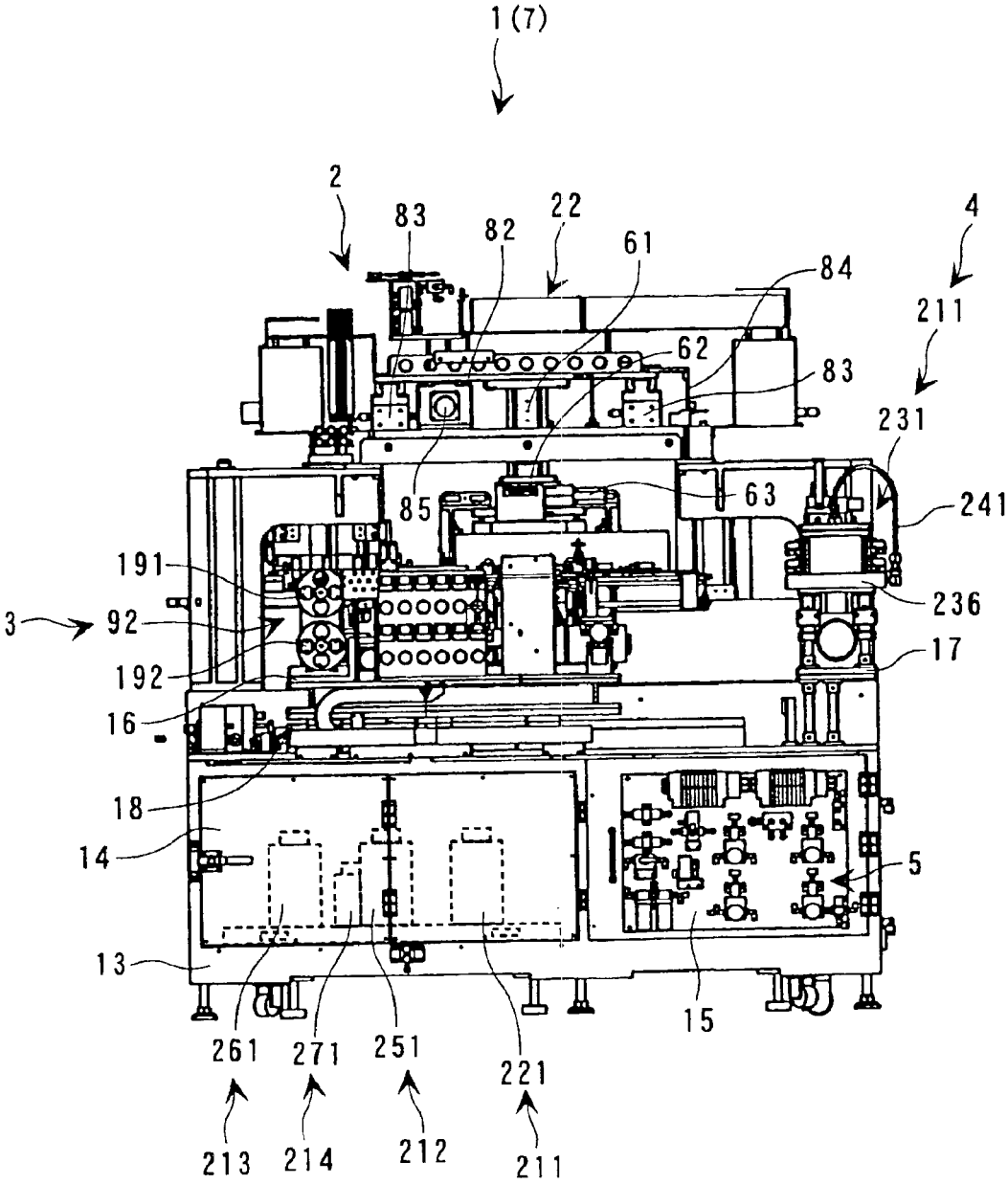
FIG. 3 is a right-side view thereof.

With reference to the accompanying drawings, a first embodiment of this invention will be described below. FIG. 1 is an external perspective view of a liquid droplet ejection apparatus 1 to which this invention is applied. FIG. 2 is a front view of the liquid droplet ejection apparatus 1 to which this invention is applied. FIG. 3 is a right-side view of the liquid droplet ejection apparatus 1 to which this invention is applied. This liquid droplet ejection apparatus 1, which will be described later in detail, introduces a function liquid, such as a peculiar ink, a luminous resin liquid, or the like, into a function liquid droplet ejection head 31 so as to form a film formation part (or a film-formed portion) by using the function liquid onto a workpiece W in the form of a substrate, or the like.

As shown in FIGS. 1 to 3, the liquid droplet ejection apparatus 1 is made up of: ejection means 2 (drawing means) for ejecting the function liquid; maintenance means 3 for performing maintenance of the ejection means 2; function liquid supply/recovery means 4 for supplying the function liquid to the ejection means 2 and recovering unnecessary function liquid; and air supply means 5 (pressurization feed means) for supplying compressed air for driving/controlling respective means. The respective means described above are controlled by control means 6 while being associated with each other. Although not shown in the drawings, accessory devices such as a workpiece recognition camera which recognizes a position of the workpiece W, a head recognition camera which confirms a position of a head unit 21 (to be described later) of the ejection means 2 and various indicators are provided besides the above. These accessory devices are also controlled by the control means 6.

As shown in FIGS. 1 to 3, a flushing unit 93 (to be described later) for the ejection means 2 and the maintenance means 3 is disposed on a stone surface plate 12 fixed to an upper part of a stand 11 constructed by assembling angle members in a rectangular shape. The function liquid supply/recovery means 4 and the air supply means 5 are mostly fitted in a machine stage 13 attached to the stand 11. In the machine stage 13, two chambers, large and small ones, are formed. In the large chamber 14, tanks of the function liquid supply/recovery means 4 are housed. In the small chamber 15, a main part of the air supply means 5 is housed. On the machine stage 13, there are provided: a tank base 17 on which a supply tank 231 (function liquid tank) of the function liquid supply/recovery means 4, which will be described later, is placed; and a movable table 18 supported in a manner to be slidable in a longitudinal direction (that is an X-axis direction) of the machine stage 13. On the movable table 18, a common base 16 is fixed, on which a suction unit 91 (to be described later) of the maintenance means 3 and a wiping unit 92 (to be described later) thereof are placed.

This liquid droplet ejection apparatus 1 supplies the function liquid to the function liquid droplet ejection head 31 from the supply tank 231 of the function liquid supply/recovery means 4 and ejects the function liquid to the workpiece W from the function liquid droplet ejection head 31 while allowing the maintenance means 3 to maintain the function liquid droplet ejection head 31 of the ejection means 2. The respective means will be described below.

The ejection means 2 is made up of: the head unit 21 having a plurality of function liquid droplet ejection heads 31 which eject the function liquid; a main carriage 22 which supports the head unit 21; and an X/Y moving mechanism 23 which moves for scanning the workpiece W placed thereon relative to the function liquid droplet ejection heads 31.

Figure 4:
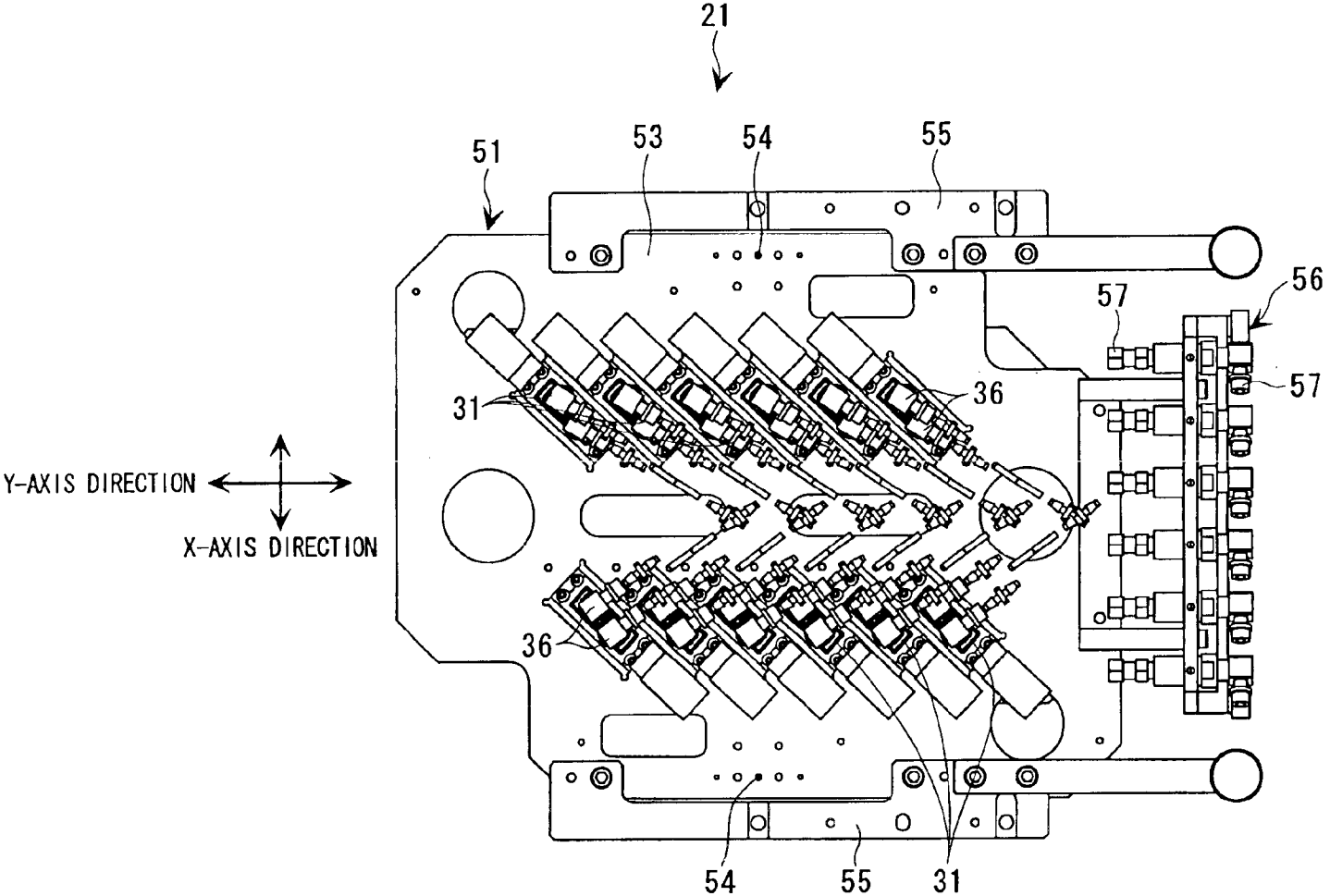
FIG. 4 is a plan view of a head unit.
Figure 5A:
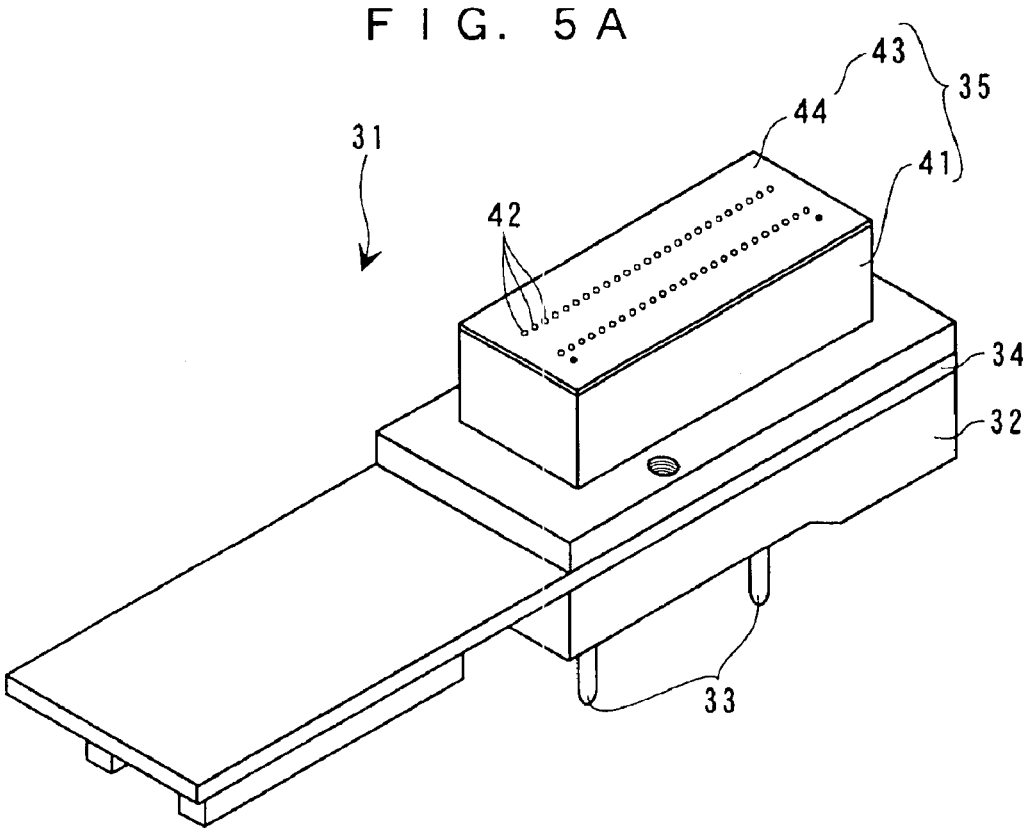
FIG. 5A is an external perspective view of a function liquid droplet ejection head.

As shown in FIGS. 4 and 5A, the head unit 21 is made up of: the plurality (twelve) of function liquid droplet ejection heads 31; a sub-carriage 51 which mounts the plurality of function liquid droplet ejection heads 31; and a head holding member 52 for fitting the respective function liquid droplet ejection heads 31 to the sub-carriage 51 by allowing a nozzle forming surface 44 (nozzle surface) of each of the function liquid droplet ejection heads 31 to protrude downward. The twelve function liquid droplet ejection heads 31 are divided into two rows, each row having six thereof, and are disposed on the sub-carriage 51 while being tilted at a predetermined angle in order to secure a sufficient application density of the function liquid to the workpiece W. The divided six function liquid droplet ejection heads 31 are disposed while being shifted from each other in a sub-scanning direction (Y-axis direction). Here, ejection nozzles 42 of each function liquid droplet ejection head 31 are made to be continuous (partially overlapping) in the sub-scanning direction. Note that it is not required to set the function liquid droplet ejection heads 31 to be tilted if the sufficient application density of the function liquid to the workpiece W can be secured by constructing the function liquid droplet ejection heads 31 by using exclusively used components.

Figure 5B:
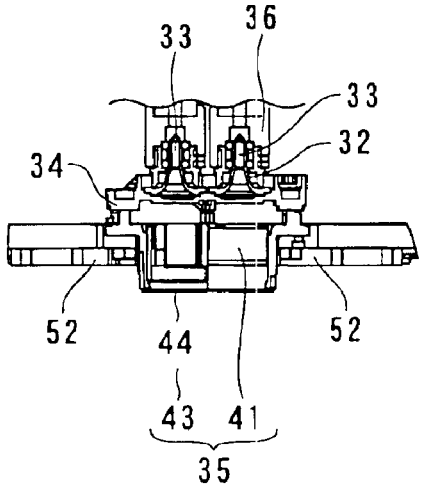
FIG. 5B is a cross-sectional view when the function liquid droplet ejection head is fitted to a piping adaptor.

As shown in FIGS. 5A and 5B, the function liquid droplet ejection head 31 is made up of: a so-called twin function liquid introduction part 32 having twin connection needles 33; a twin head substrate 34 connected to the function liquid introduction part 32; and a head main body 35 which is connected under the function liquid introduction part 32 and has an inner passage formed therein (i.e., a passage inside the function liquid droplet ejection head), the inner passage being filled with the function liquid. Each of the connection needles 33 is connected to the supply tank 231 of the function liquid supply/recovery means 4 through a piping adaptor 36. Thus, the function liquid introduction part 32 receives a supply of the function liquid from each connection needle 33. The head main body 35 includes a twin pump part 41 and a nozzle forming plate 43 having a nozzle forming surface 44 on which a number of ejection nozzles 42 are formed. In the function liquid droplet ejection head 31, the function liquid is ejected from the ejection nozzles 42 by an action of the pump part 41. On the nozzle forming surface 44, two ejection nozzle arrays including the number of ejection nozzles 42 are formed.

As shown in FIG. 4, the sub-carriage 51 is made up of: a partially notched main body plate 53; a pair of reference pins 54 which are provided, respectively, at intermediate positions in a long side direction of the main body plate 53; and a pair of supporting members 55 which are fitted, respectively, to both long side portions of the main body plate 53. On the premise of image recognition, the pair of reference pins 54 become references for positioning (positional recognition) of the sub-carriage 51 (the head unit 21) in X-axis, Y-axis and θ-axis directions. The supporting members 55 become fixation parts when the head unit 21 is fixed to the main carriage 22. Moreover, in the sub-carriage 51, a piping joint 56 is provided to connect the respective function liquid droplet ejection heads 31 with the supply tank 231 through piping. The piping joint 56 has one end connected to head side piping members from the piping adaptors 36 connected to (the connection needles 33 of) the respective function liquid droplet ejection heads 31. On the other end thereof, the piping joint 56 has twelve sockets 57 for connecting apparatus side piping members from the supply tank 231.

As shown in FIG. 3, the main carriage 22 is made up of: a hanging member 61 having an "I"-shaped appearance, which is fixed from a lower side by a bridge plate 82 to be described later; a θ table 62 attached to a lower surface of the hanging member 61; and a carriage main body 63 attached to the θ table 62 so as to be hung therebelow. The carriage main body 63 has a rectangular aperture for loosely fitting the head unit 21 and positions and fixes the head unit 21. In the carriage main body 63, a workpiece recognition camera for recognizing the workpiece W is disposed.

As shown in FIGS. 1 to 3, the X/Y moving mechanism 23 is fixed to the above-described stone surface plate 12. The X/Y moving mechanism 23 moves the workpiece W in the main-scanning direction (the X-axis direction) and moves the head unit 21 in the sub-scanning direction (the Y-axis direction) through the main carriage 22. The X/Y moving mechanism 23 is made up of: an X-axis table 71 which is fixed while aligning its axis line with a center line along the long side of the stone surface plate 12; and a Y-axis table 81 disposed across the X-axis table 71 while aligning its axis line with a center line along a short side of the stone surface plate 12.

The X-axis table 71 is made up of: a suction table 72 which sets the workpiece W by air suction; a θ table 73 which supports the suction table 72; an X-axis air slider 74 which supports the θ table 73 so as to be slidable in the X-axis direction; an X-axis linear motor (not illustrated) which moves the workpiece W on the suction table 72 in the X-axis direction through the θ table 73; and an X-axis linear scale 75 which is provided beside the X-axis air slider 74. The main scanning of the function liquid droplet ejection head 31 is performed in such a manner that the X-axis linear motor is driven to move the suction table 72 having the substrate W sucked (or adhered) thereto and the θ table 73 back and forth in the X-axis direction while using the X-axis air slider 74 as a guide.

The Y-axis table 81 is made up of: the bridge plate 82 for hanging the main carriage 22; a pair of Y-axis sliders 83 which hold the bridge plate 82 on its both sides and support the bridge plate 82 o as to be slidable in the Y-axis direction; a Y-axis linear scale 84 which is provided beside the Y-axis sliders 83; a Y-axis ball screw 85 which moves the bridge plate 82 in the Y-axis direction by guiding the pair of Y-axis sliders 83; and a Y-axis motor (not illustrated) which rotates the Y-axis ball screw 85 forward and backward. The Y-axis motor is constituted by a servo motor. When the Y-axis motor is rotated forward (in normal direction of rotation) and backward (in the reverse direction of rotation), the bridge plate 82, which is engaged in a screwed manner with the Y-axis ball screw 85, is moved in the Y-axis direction by using the pair of Y-axis sliders 83 as a guide through the Y-axis ball screw 85. Namely, along with the movement of the bridge plate 82, the main carriage 22 (the head unit 21) is moved back and forth in the Y-axis direction and sub-scanning of the function liquid droplet ejection heads 31 is performed.

A series of operations of the ejection means 2 will now be briefly described. First, as a preparation prior to ejection of the function liquid, a position of the head unit 21 is corrected by means of the head recognition camera. Thereafter, a position of the workpiece W set on the suction table 72 is corrected by the workpiece recognition camera. Next, the workpiece W is moved back and forth in the main scanning (the X-axis) direction by the X/Y moving mechanism 23 (the X-axis table 71). At the same time, the plurality of function liquid droplet ejection heads 31 are driven to perform a selective ejection operation of the function liquid to the workpiece W. Subsequently, after moving the workpiece W back, the head unit 21 is moved in the sub-scanning (the Y-axis) direction by the X/Y moving mechanism 23 (the Y-axis table 81) and the back-and-forth movement of the workpiece W in the main scanning direction and the driving of the function liquid droplet ejection heads 31 are performed again. In this embodiment, the workpiece W is moved in the main scanning direction with respect to the head unit 21. However, the head unit 21 may be moved in the main scanning direction. Moreover, the workpiece W may be moved in the main-scanning and sub-scanning directions while fixing the head unit 21.

Next, the maintenance means 3 will be described. The maintenance means 3 maintains the function liquid droplet ejection heads 31 so that the function liquid droplet ejection heads 31 properly eject the function liquid, and is made up of the suction unit 91, the wiping unit 92, the flushing unit 93 and a passage cleaning unit 94.

Figure 6:
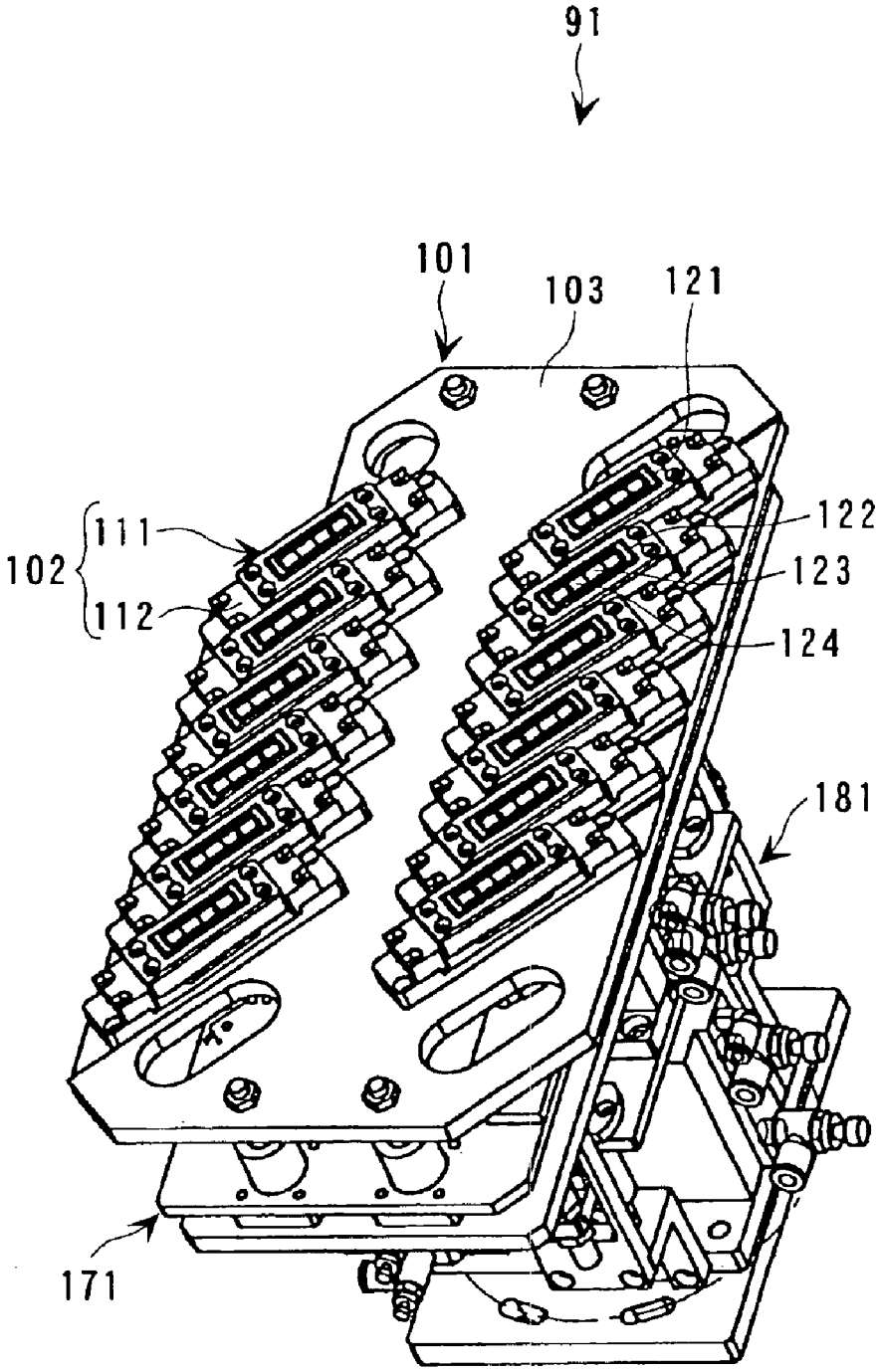
FIG. 6 is an external perspective view of a suction unit.
Figure 13:
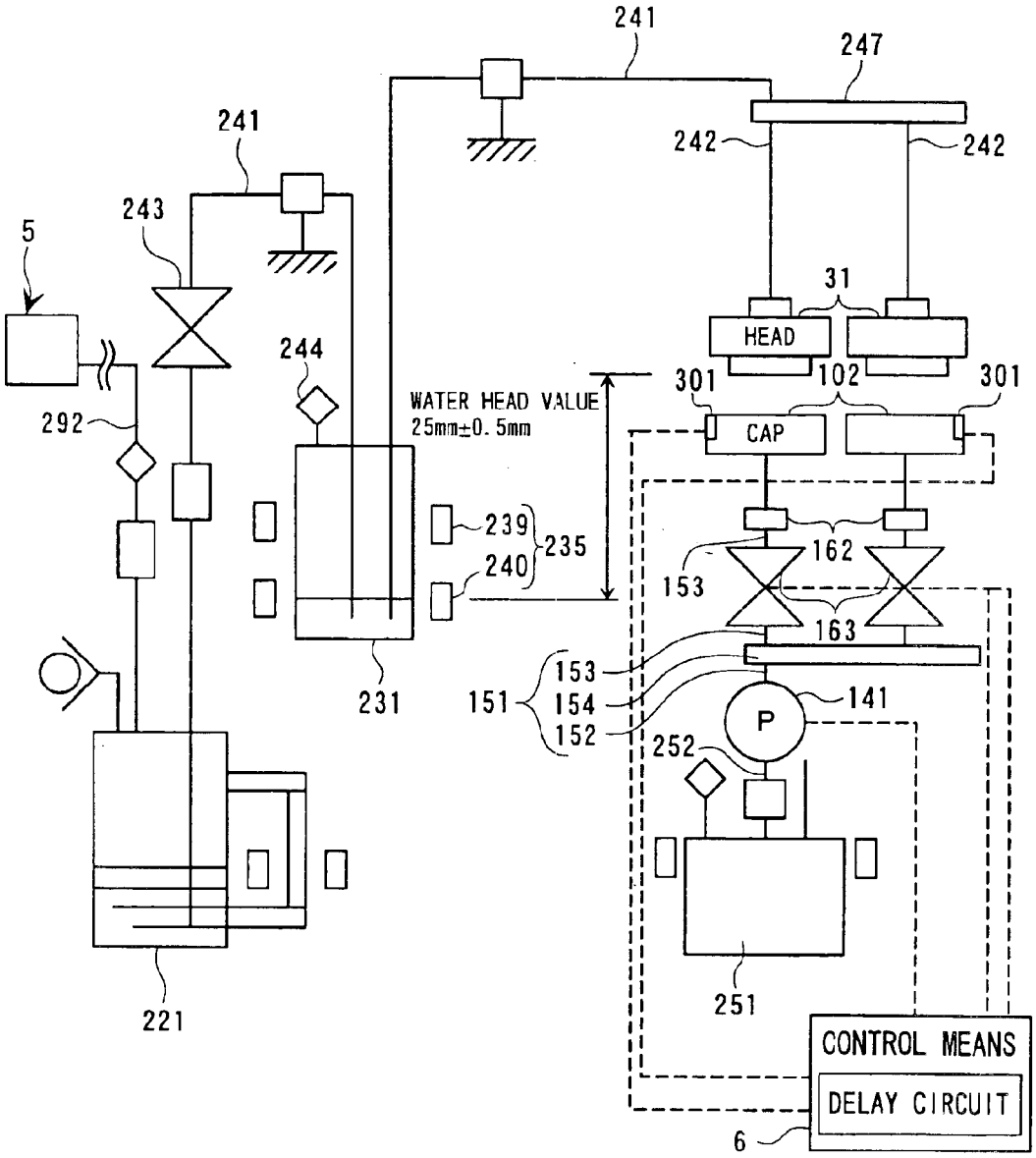
FIG. 13 is a schematic diagram, according to a first embodiment of this invention, showing a function liquid droplet ejection head, a function liquid supply system, air supply means, and a suction unit, which are connected to the function liquid droplet ejection head.

As shown in FIG. 1, the suction unit 91 is placed on the common base 16 of the machine stage 13 described above and is arranged to be slidable in a longitudinal direction of the machine stage 13, i.e., in the X-axis direction through the movable table 18. The suction unit 91 is for maintaining the function liquid droplet ejection heads 31 by performing suction of the function liquid droplet ejection heads 31. The suction unit 91 is used in the case of filling (the function liquid droplet ejection heads 31 of) the head unit 21 with the function liquid and in the case of performing suction (cleaning) for removing the function liquid thickened in the function liquid droplet ejection heads 31. With reference to FIGS. 6 and 13, the suction unit 91 is made up of: a cap unit 101 having twelve head caps 102; a function liquid suction pump 141 which performs suction of the function liquid through the head caps 102; a suction tube unit 151 which connects the respective head caps 102 with the function liquid suction pump 141; a supporting member 171 which supports the cap unit 101; and a lift mechanism 181 (capping means) which lifts up and down the cap unit 101 through the supporting member 171.

As shown in FIG. 6, in the cap unit 101, the twelve head caps 102 are disposed on a cap base 103 in accordance with the disposition of the twelve function liquid droplet ejection heads 31 mounted on the head unit 21. The respective head caps 102 are arranged to be capable of being adhered to the corresponding function liquid droplet ejection heads 31.

Figure 8:
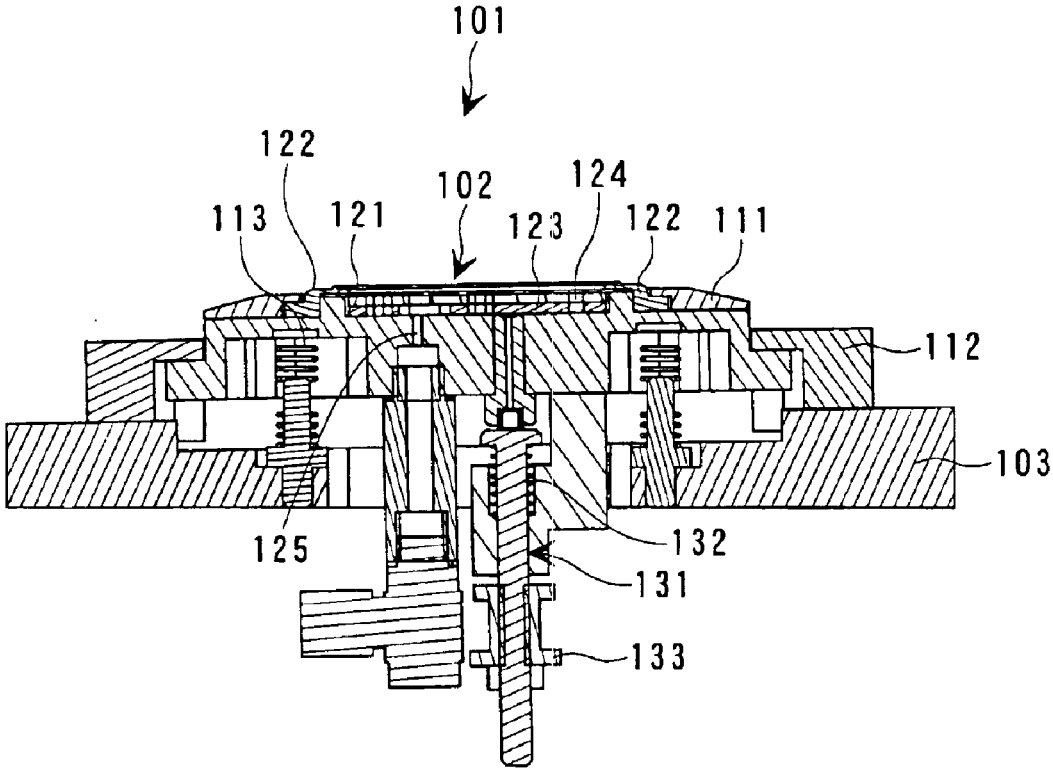
FIG. 8 is a cross-sectional view around a cap.

As shown in FIG. 8, each of the head caps 102 is made up of a cap main body 111 and a cap holder 112. The cap main body 111 is urged upward by two springs 113 and held by the cap holder 112 in a state of being capable of slight vertical movement. In an upper surface of the cap main body 111, a concave part 121 is formed, which includes each of the two arrays of ejection nozzles 42 of the function liquid droplet ejection head 31. In a peripheral portion of the concave part 121, a seal packing 122 is fitted. An absorber 123 is laid on a bottom of the concave part 121 in a state of being pressed by a pressing frame 124. In suction of the function liquid droplet ejection head 31, the seal packing 122 is pressed against the nozzle forming surface 44 of the function liquid droplet ejection head 31 and is closely adhered thereto. Thus, the nozzle forming surface 42 is sealed so as to include the two arrays of ejection nozzles 42 therein. Moreover, a small hole 125 is formed on the bottom of the concave part 121 and this small hole 125 communicates with an L-shaped joint connected to each branched suction tube 153 to be described later.

Moreover, an air open valve (i.e., a valve to relieve the pressure to atmosphere; a relief valve) 131 is provided in each of the head caps 102 so that air can be released at the bottom side of the concave part 121 (see FIG. 8). The air open valve 131 is urged upward by a spring 132 toward a closing side and is opened and closed through an operation plate 176 to be described later. At the final stage of the suction operation of the function liquid, an operation part 133 of the air open valve 131 is pulled down through the operation plate 176 to open the valve. Thus, the function liquid contained in the absorber 123 can be also sucked. As described later in detail, detection means 161 (see FIG. 11A) is provided in each of the head caps 102. The detection means 161 detects the presence or absence of the function liquid flowing therethrough.

The function liquid suction pump 141 causes a suction force to operate onto the function liquid droplet ejection head 31 through each of the head caps 102, and is constituted by a piston pump to facilitate maintenance.

As shown in FIG. 13, the suction tube unit 151 is made up of: a function liquid suction tube 152 which is connected to the function liquid suction pump 141; a plurality (twelve) of branched suction tubes 153 which are connected to the respective head caps 102; and a header pipe 154 for connecting the function liquid suction tube 152 with the branched suction tubes 153. Namely, the function liquid suction tube 152 and the branched suction tubes 153 form a function liquid passage which connects the head caps 102 with the function liquid suction pump 141. As shown in FIG. 13, in each of the branched suction tubes 153, a cap side (or cap-side) pressure sensor (i.e., a pressure sensor on the side of the cap) 162 and a suction opening/closing valve 163 are provided in the described order as seen from the side of the head cap 102. The cap side pressure sensor 162 detects a pressure in the branched suction tube 153. Moreover, the suction opening/closing valve 163 closes the branched suction tube 153. In this embodiment, the detection means 161 is provided in each of the head caps 102. However, the detection means 161 may be provided in each of the branched suction tubes 153. Moreover, the detection means 161 may be provided in both of the head cap 102 and the branched suction tube 153 (details thereof will be described later).

Figure 7:
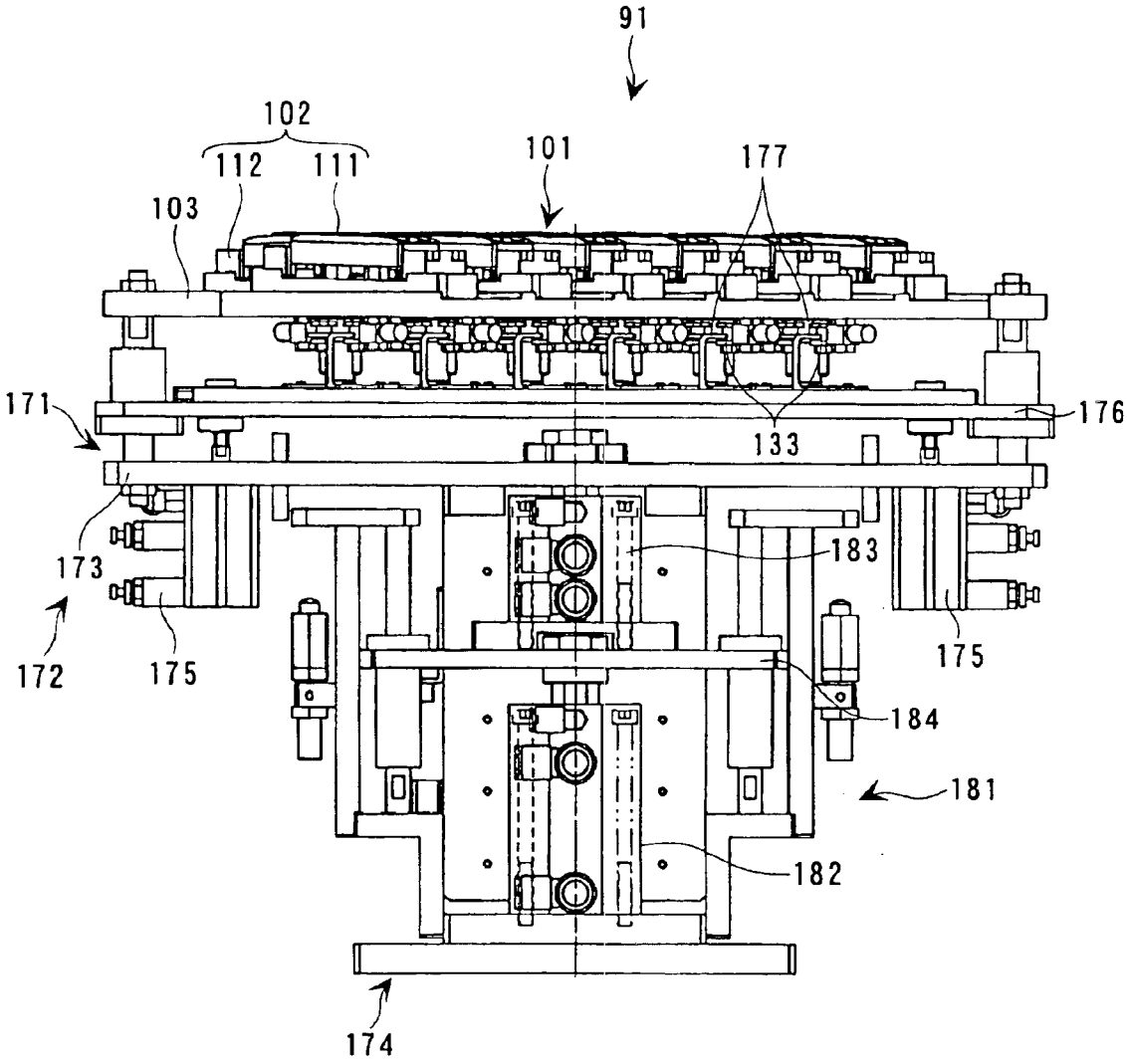
FIG. 7 is a front view thereof.

As shown in FIG. 7, the supporting member 171 is made up of: a supporting member main body 172 which has a supporting plate 173 for supporting the cap unit 101 on its upper end; and a stand 174 which supports the supporting member main body 172 so as to be slidable in a vertical direction. At both sides of a lower surface of the supporting plate 173 in its longitudinal direction, a pair of air cylinders 175 are fixed. By using this pair of air cylinders 175, an operation plate 176 is lifted up and down. On the operation plate 176, hooks 177 are attached, each of which is engaged with the operation part 133 of the air open valve 131 of each of the head caps 102. Along with the up-and-down movement of the operation plate 176, the hook 177 raises and lowers the operation part 133. Thus, the air open valve 131 described above is opened and closed.

As shown in FIG. 7, the lift mechanism 181 is provided with two lift cylinders made of the air cylinders 175, i.e., a lower lift cylinder 182 provided upright in a base part of the stand 174, and an upper lift cylinder 183 provided upright on a lift plate 184 which is lifted up and down by the lower lift cylinder 182. On the supporting plate 173, a piston rod of the upper lift cylinder 183 is connected. The both lift cylinders have strokes different from each other. A selection operation by the both lift cylinders can freely switch a lifted position of the cap unit 101 between a first position, which is relatively high, and a second position, which is relatively low. When the cap unit 101 is at the first position, each of the head caps 102 is adhered to each function liquid droplet ejection head 31 and, when the cap unit 101 is at the second position, there occurs a narrow gap between the function liquid droplet ejection head 31 and the head cap 102.

As described later in detail, the respective head caps 102 of the cap unit 101 also serve as function liquid trays which catch the function liquid ejected by flushing (preliminary ejection) of the function liquid droplet ejection heads 31 at the time of non-ejection of the function liquid. In the case of sucking the function liquid droplet ejection heads 31 through the respective head caps 102, such as when the passages inside the function liquid droplet ejection heads 31 are filled with the function liquid or when cleaning of the function liquid droplet ejection heads 31 is performed, the lift mechanism 181 moves the cap unit 101 to the first position to adhere the respective head caps 102 to the respective function liquid droplet ejection heads 31. Meanwhile, in case where the function liquid droplet ejection heads 31 perform the flushing, the lift mechanism 181 moves the cap unit 101 to the second position.

The wiping unit 92 wipes the nozzle forming surface 44 of the function liquid droplet ejection head 31 contaminated by the function liquid adhered thereto, by performing suction (cleaning), or the like, of the function liquid droplet ejection head 31. The wiping unit 92 is made up of a winding sub-unit 191 and a wiping sub-unit 192 which are provided in a state of facing each other on the common base 16 (see FIGS. 1 and 3). For example, once cleaning of the function liquid droplet ejection head 31 is completed, the wiping unit 92 is moved by the above-described movable table 18 to a position which fronts the function liquid droplet ejection head 31. In a state of being sufficiently close to the function liquid droplet ejection head 31, the wiping unit 92 takes out a wiping sheet (not illustrated) from the winding sub-unit 191 and wipes the nozzle forming surface 44 of the function liquid droplet ejection head 31 by the taken out wiping sheet by using a wiping roller (not illustrated) of the wiping sub-unit 192. The taken out wiping sheet is supplied with a cleaning liquid from a cleaning liquid supply system 213 to be described later. Thus, the function liquid adhered to the function liquid droplet ejection head 31 can be efficiently wiped off.

The flushing unit 93 is for receiving the function liquid sequentially ejected by flushing operations (preliminary ejections) of the plurality (twelve) of function liquid droplet ejection heads 31 in ejection of the function liquid (to the workpiece W). The flushing unit 93 includes a pair of flushing boxes 201 (only one thereof is illustrated) which are fixed to the θ table 73 while sandwiching the suction table 72 of the X-axis table 71 (see FIG. 1). The flushing boxes 201 are moved together with the θ table 73 in the main scanning. Thus, the head unit 21 and the like are not moved for the flushing operations. In other words, the flushing boxes 201 are moved toward the head unit 21 together with the workpiece W. Thus, the flushing operations can be performed sequentially from the ejection nozzles 42 of the function liquid droplet ejection head which fronts the flushing boxes 201. The function liquid received by the flushing boxes 201 is stored in a waste liquid tank 271 to be described later.

In the flushing operations, the function liquid is ejected from all the ejection nozzles 42 of all the function liquid droplet ejection heads 31. With passage of time, the function liquid introduced into the function liquid droplet ejection heads 31 is thickened as a result of drying and causes clogging of the ejection nozzles 42 of the function liquid droplet ejection heads 31. Accordingly, the flushing operations are performed periodically in order to prevent the clogging. It is required to perform the flushing operations not only at the time of ejection of the function liquid but also at the time of non-ejection of the function liquid (standby) where ejection of the function liquid is temporarily stopped, such as when the workpiece W is replaced. In this case, the head unit 21 is moved to a cleaning position, i.e., to a position immediately above the cap unit 101 of the suction unit 91. Thereafter, the respective function liquid droplet ejection heads 31 perform the flushing toward the respective head caps 102 corresponding thereto.

Figure 9:
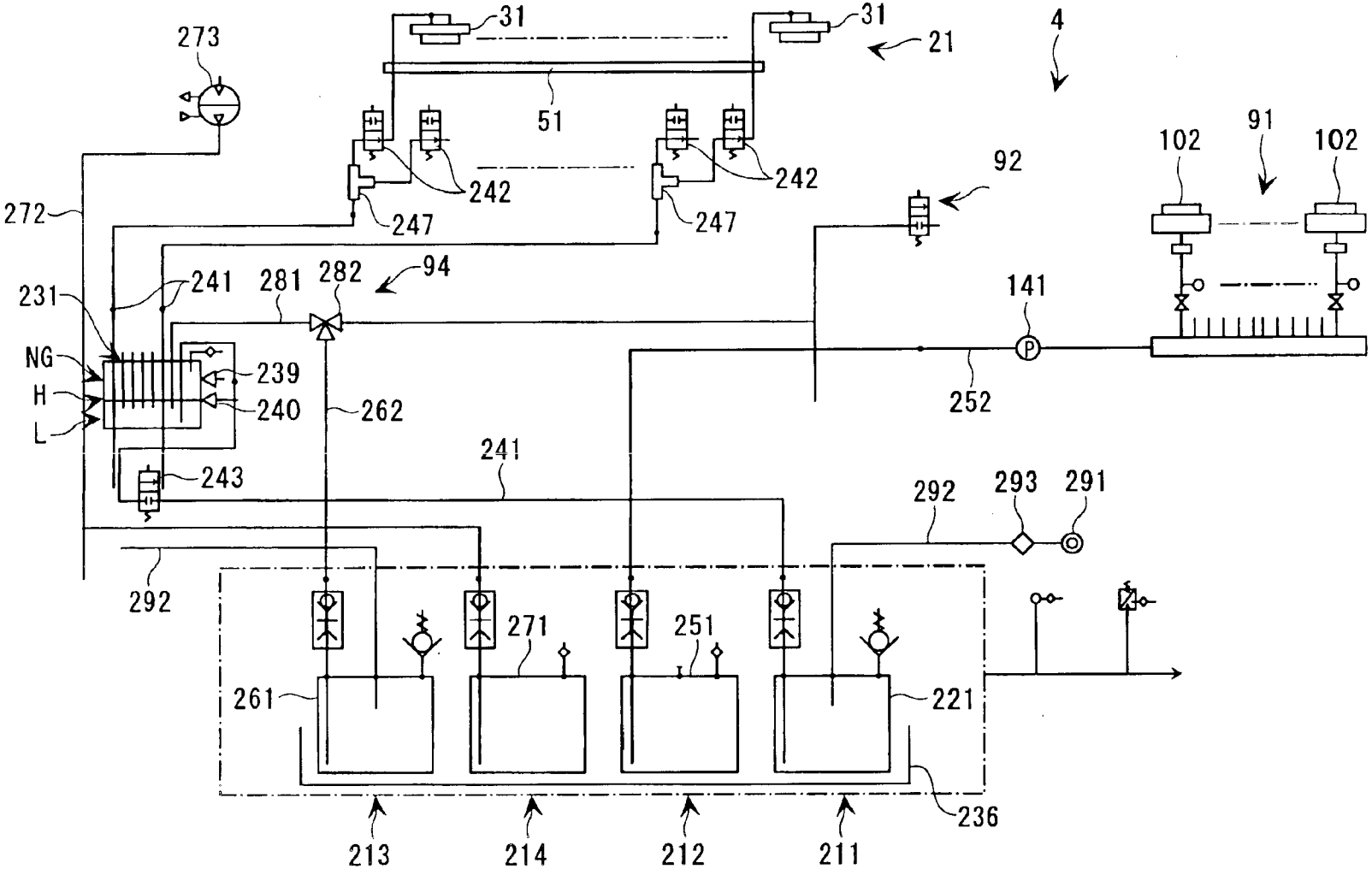
FIG. 9 is a schematic diagram showing a function liquid supply system, a function liquid recovery system, a cleaning liquid supply system, and a waste liquid recovery system.

As shown in FIG. 9, the passage cleaning unit 94 is for cleaning all passages of the function liquid by feeding a cleaning liquid to all the passages from the supply tank 231 to a recovery tube 252. The passage cleaning unit 94 is made up of: a passage cleaning supply tube 281 which is connected to a cleaning liquid tank 261 (to be described later) through a cleaning liquid supply tube 262 (to be described later); and a three-way valve 282 which connects the cleaning liquid supply tube 262 and the passage cleaning supply tube 281 with each other. The three-way valve 282 is normally set at the wiping unit 92 side and is switched to the supply tank 231 side at the time of passage cleaning. Thus, the cleaning liquid is supplied to the passage cleaning supply tubes 241 and the cleaning liquid is fed to all the passages of the function liquid. An air supply tube 292 connected to the air supply means 5 is connected to the cleaning liquid tank 261 so that the cleaning liquid is pressurized and fed (i.e., is fed under pressure). In stead of the cleaning liquid tank 261, an exclusively used tank for the passage cleaning unit 94 may be provided.

Next, the function liquid supply/recovery means 4 will be described. The function liquid supply/recovery means 4 is made up of: a function liquid supply system 211 (function liquid supply apparatus) which supplies the function liquid to the respective function liquid droplet ejection heads 31 of the head unit 21; a function liquid recovery system 212 which recovers the function liquid sucked by the suction unit 91 of the maintenance means 3; a cleaning liquid supply system 213 which supplies a function material solvent for cleaning to the wiping unit 92 and the passage cleaning unit 94; and a waste liquid recovery system 214 which recovers the function liquid received by the flushing unit 93. As shown in FIG. 3, in the large chamber 14 of the machine stage 13, a pressurization tank 221 of the function liquid supply system 211, a recycling tank 251 of the function liquid recovery system 212, and the cleaning liquid tank 261 of the cleaning liquid supply system 213 are horizontally disposed in the order as described from the right side of the drawing sheet. In addition, in the vicinity of the recycling tank 251 and the cleaning liquid tank 261, a small-sized waste liquid tank 271 of the waste liquid recovery system 214 is provided.

As shown in FIGS. 9 and 13, the function liquid supply system 211 is made up of: the pressurization tank 221 which stores a large amount (3 L) of the function liquid; the supply tank 231 (function liquid tank) which stores the function liquid sent from the pressurization tank 221 and supplies the function liquid to the respective function liquid droplet ejection heads 31; and a supply tube 241 which forms supply lines and connect these supply lines by piping. The air supply tube 292 connected to the air supply means 5 (to be described later) is connected to the pressurization tank 221 so that the function liquid can be fed under pressure. In the supply tank 231, an air open valve 244 is provided to release the pressure in the supply tank 231 to the atmosphere.

Figure 10:
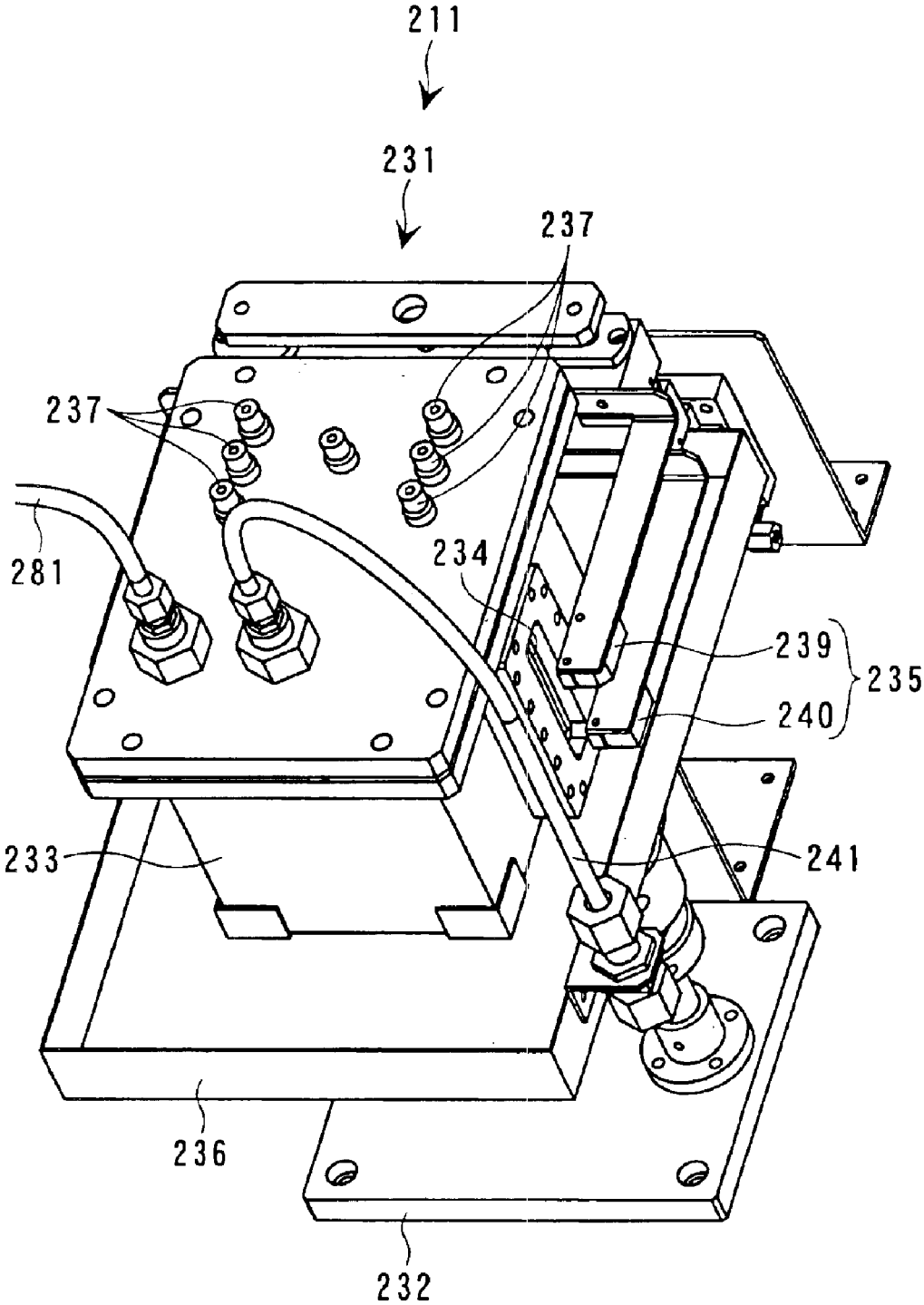
FIG. 10 is an external perspective view around a supply tank.

As shown in FIG. 10, the supply tank 231 is fixed on the tank base 17 of the machine stage 13 described above. The supply tank 231 has liquid level windows (peep holes) 234 on both sides thereof and includes: a tank main body 233 which stores the function liquid from the pressurization tank 221; a liquid level detector 235 which fronts the both liquid level windows 234 and detects a liquid level (water level) of the function liquid; a pan 236 on which the tank main body 233 is placed; and a tank stand 232 which supports the tank main body 233 through the pan 236.

As shown in FIG. 10, on an upper surface of (a lid body of) the tank main body 233, the supply tube 241 connected to the pressurization tank 221 is connected and six supply connectors 237 for the supply tube 241, which extend toward the head unit 21, are provided. The liquid level detector 235 is made up of: an upper limit level detector 239 which detects an upper limit of the function liquid, i.e., which detects the overflowing; and a control liquid level detector 240 which detects a control liquid level of the function liquid in order to maintain a proper water head pressure. In the supply tube 241 connected to the pressurization tank 221, a liquid level adjusting valve 243 is interposed. By controlling the liquid level adjusting valve 243 to be opened and closed, the liquid level of the function liquid stored in the tank main body 233 is controlled to be always within a detection range of the liquid level detector 235.

As shown in FIGS. 9 and 13, the six supply tubes 241 extending to the function liquid droplet ejection heads 31 are connected to the supply tank 231. Further, each of the supply tubes 241 is biforked through a T-joint 247 and thus twelve branched supply tubes 242 (branched supply pipelines) are formed in total. The twelve branched supply tubes 242 are connected to the twelve sockets 57 of the piping joint 56 provided in the head unit 21 as apparatus side piping members.

As shown in FIG. 9, the function liquid recovery system 212 stores the function liquid sucked by the suction unit 91. The function liquid recovery system 212 is made up of: the recycling tank 251 which stores the sucked function liquid; and the recovery tube 252 which is connected to the recycling tank 251 and the function liquid suction pump 141 so as to guide the sucked function liquid to the recycling tank 251.

As shown in FIG. 9, the cleaning liquid supply system 213 supplies the cleaning liquid to the wiping sheet of the wiping unit 92 and the passage cleaning supply tube 281 of the passage cleaning unit 94. The cleaning liquid supply system 213 includes the cleaning liquid tank 261 which stores the cleaning liquid, and the cleaning liquid supply tube 262 for supplying the cleaning liquid of the cleaning liquid tank 261. The cleaning liquid is supplied by pressurization (i.e., under pressure) and, therefore, the cleaning liquid is supplied by introducing compressed gas (nitrogen gas) to the cleaning liquid tank 261 from the air supply means 5 through the air supply tube 292. Moreover, a solvent having relatively high volatility is used as the cleaning liquid.

As shown in FIG. 9, the waste liquid recovery system 214 recovers the function liquid ejected to the flushing unit 93. The waste liquid recovery system 214 is made up of: the waste liquid tank 271 which stores the recovered function liquid; a waste liquid tube 272 which is connected to the flushing unit 93 and guides the function liquid, which is ejected to the flushing unit 93, to the waste liquid tank 271; and a waste liquid pump 273.

Next, the air supply means 5 will be described. As shown in FIGS. 9 and 13, the air supply means 5 supplies compressed air (or gas) obtained by compressing inert gas ($N_2$) to the respective parts such as the pressurization tank 221 and the cleaning liquid tank 261, for example. The air supply means 5 is made up of: an air pump 291 for compressing the inert gas; and the air supply tube 292 (a pipeline for pressurization) for supplying the air compressed by the air pump 291 to the respective parts. In the air supply tube 292, there is provided a regulator 293 for maintaining a pressure therein at a predetermined constant pressure in accordance with a destination to which the compressed air is supplied. The constitutions of the respective parts of the air supply means 5 are omitted in FIG. 13 but are similar to those of the air supply means 5 according to a second embodiment shown in FIG. 14.

Figure 11A:
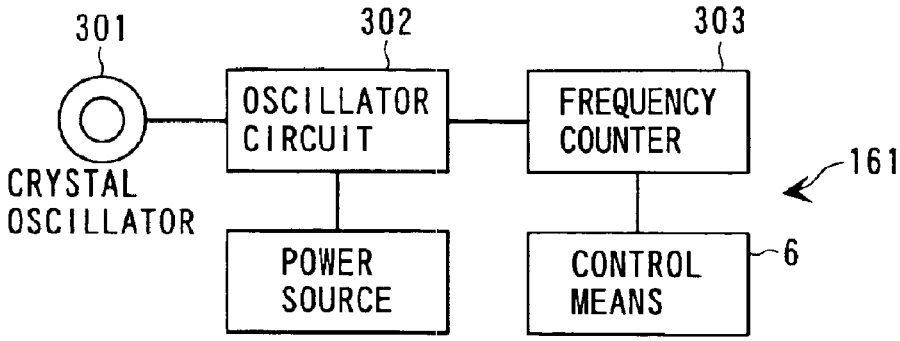
FIG. 11A is a schematic diagram showing a crystal oscillator, an oscillator circuit, a frequency counter, and control means.

The detection means 161 provided in the head cap 102 detects a state in that the function liquid reaches inside the head cap 102. As shown in FIG. 11A, the detection means 161 is made up of: a crystal oscillator 301; an oscillator circuit 302 for allowing the crystal oscillator 301 to stably oscillate; and a frequency counter 303 which measures an oscillation frequency of the crystal oscillator 301. The frequency counter 303 is connected to the control means 6 and controlled thereby.

Figure 11B:
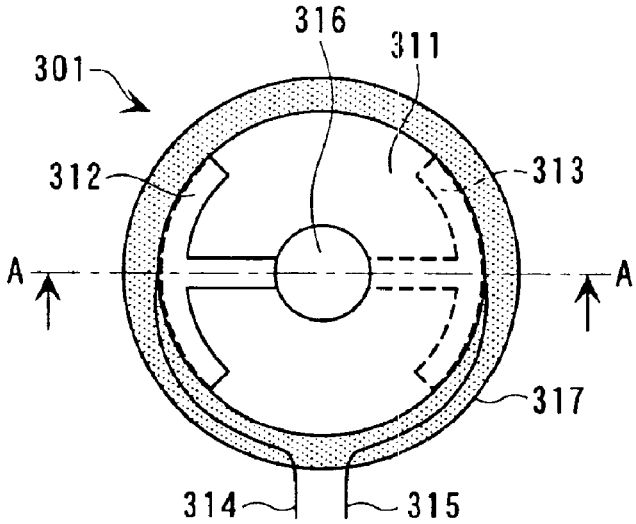
FIG. 11B is a plan view of the crystal oscillator.
Figure 11C:
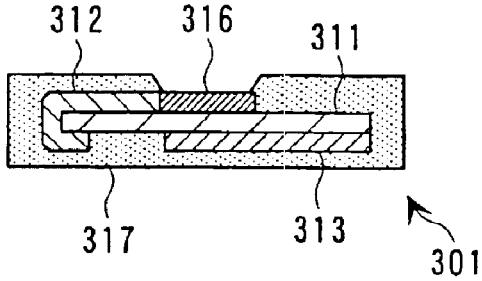
FIG. 11C is a cross-sectional view thereof.

As shown in FIGS. 11B and 11C, the crystal oscillator 301 is made up of: a crystal chip 311 subjected to AT cut; and electrodes 312 and 313 which are attached to both sides of the crystal chip. Moreover, leads 314 and 315 are electrically connected to the electrodes 312 and 313, respectively. In consideration of corrosion caused by the function liquid, the electrode 312 is formed of gold, silver and the like, which have high anti-corrosion characteristics. A reaction portion 316 of the electrode 312 is exposed to the function liquid. A portion of the electrode 312 other than the reaction portion 316 and the other electrode 313 are covered with a protection part 317 (mold resin or the like) so as not to be exposed to the function liquid.

As shown in FIG. 11B, the crystal oscillator 301 is connected to the oscillator circuit 302 through the leads 314 and 315. Furthermore, the oscillator circuit 302 is connected to the frequency counter 303. The oscillator circuit 302 is connected to a power source and applies a voltage to the electrodes 312 and 313 of the crystal oscillator 301. Thus, the crystal oscillator 301 is continuously oscillated.

Figure 12:
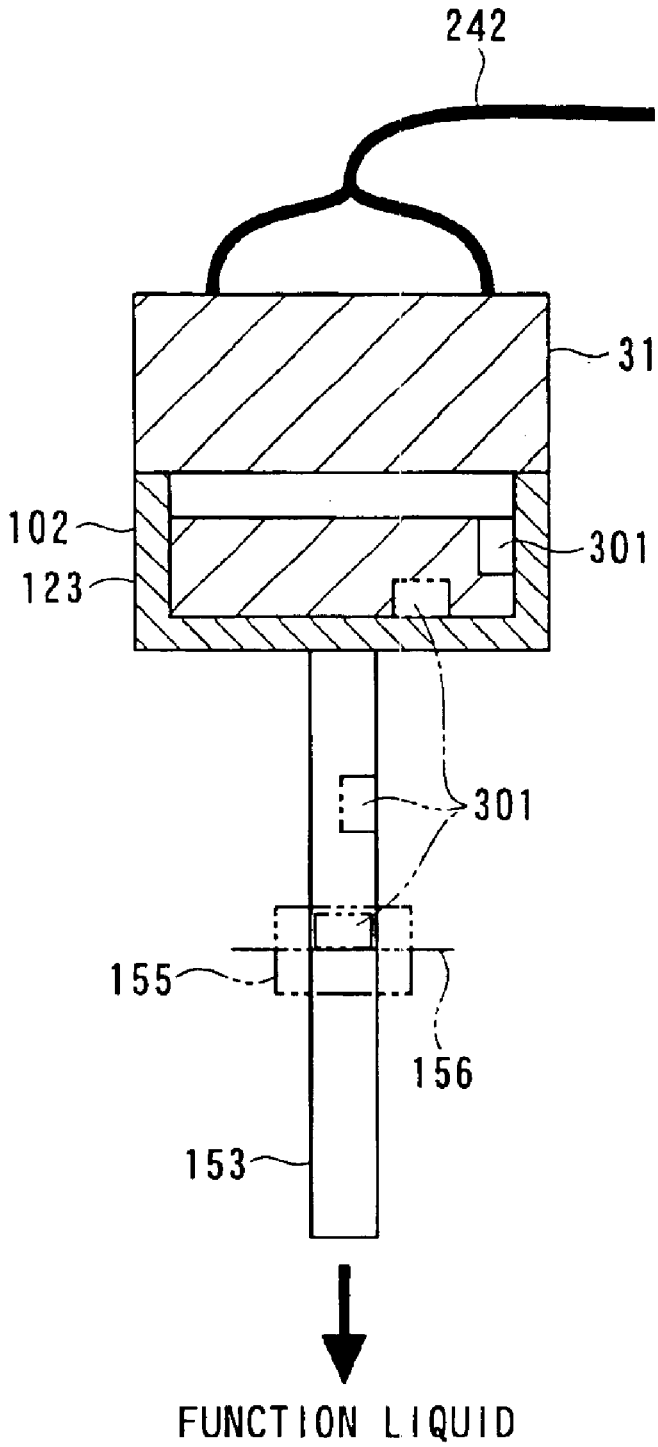
FIG. 12 is a cross-sectional view when the crystal oscillator is disposed in the head cap.

The crystal oscillator 301 arranged as described above is disposed in a sidewall portion of the head cap 102, as shown in FIG. 12. A resonance frequency of the crystal oscillator 301 is highly stable. However, when the function liquid is adhered to the reaction portion 316 of the electrode 312, the resonance frequency is reduced by a weight of the function liquid. Namely, by detecting a change in the resonance frequency of the crystal oscillator 301, it is detected whether or not the crystal oscillator 301 is immersed in the function liquid. Thus, it is possible to grasp the state or situation of filling of the function liquid in the head cap 102.

The frequency counter 303 measures the change in the resonance frequency of the crystal oscillator 301. When the resonance frequency is reduced by a fixed value or more as compared with the resonance frequency in the case where no function liquid is adhered, the frequency counter 303 transmits a function liquid detection signal to the control means 6.

In this embodiment, as shown in FIG. 12, the crystal oscillator 301 is disposed in the sidewall portion of the head cap 102 by making a hole in a shape of the crystal oscillator 301 in the absorber 123. However, as shown by a virtual line, the crystal oscillator 301 may alternatively be provided in a bottom portion of the head cap 102. Further, as shown by a virtual line, the crystal oscillator 301 may be provided in the branched suction tube 153 connected to the head cap 102. In this case, the crystal oscillator 301 may be provided in an inner wall of the branched suction tube 153. However, in order to make it possible to surely detect the presence of the bubbles in case bubbles are included in the function liquid, there is provided a joint 155 in a passage of the branched suction tube 153, and an SUS filter 156 having a fine mesh size is fitted into this joint 155. Accordingly, the crystal oscillator 301 may be disposed on an upper surface thereof. As described hereinafter in more detail, it is preferable that the crystal oscillator 301 is provided in the head cap 102, as in this embodiment, in order to detect the function liquid accumulated in the cap by flushing. It is needless to say that the crystal oscillator 301 may be provided both in the head cap 102 and in the branched suction tube 153 so that the function liquid can be surely detected. Next, the control means 6 will be described. The control means 6 includes a control unit for controlling operations of the respective means. The control unit stores control programs and control data therein and has a work area for performing various control processing. The control means 6 is connected to the respective means described above and controls the entire apparatus.

Here, as an example of the control by the control means 6, description will be given of a case where the passages in the function liquid droplet ejection head 31 are filled with the function liquid from the supply tank 231.

As described above, the following construction is employed in the liquid droplet ejection apparatus 1 of this embodiment. Namely, a slight difference of water head pressure is caused to occur between the function liquid droplet ejection head 31 and the supply tank 231 and, at the same time, the function liquid is supplied from the supply tank 231 by a pump action of the function liquid droplet ejection head 31. Therefore, in case of filling the passages inside the function liquid droplet ejection head 31 with the function liquid, like in the case of newly introducing the function liquid droplet ejection head 31, it is required to forcibly feed the function liquid. Thus, in this embodiment, the function liquid in the supply tank 231 is arranged to be sucked by the function liquid suction pump 141 through the function liquid droplet ejection head 31. Accordingly, bubbles in the function liquid passages from the supply tank 231 to the function liquid droplet ejection head 31 are discharged from the function liquid droplet ejection head 31. Simultaneously, the passages inside the function liquid droplet ejection head 31 are filled with the function liquid from the supply tank 231.

With reference to FIG. 13, first, the control means 6 moves the function liquid droplet ejection head 31 (the head unit 21) immediately above the suction unit 91. Thereafter, the lift mechanism 181 of the suction unit 91 is driven to move the head cap 102 to the first position and the head cap 102 is adhered to the function liquid droplet ejection head 31. Here, the suction pump 141 is driven to suck the function liquid. Thus, the function liquid in the supply tank 231 is sucked through the respective function liquid droplet ejection heads 31, and the passages inside the respective function liquid droplet ejection heads 31 are filled with the function liquid.

When the passages inside the function liquid droplet ejection head 31 are filled with the function liquid, the function liquid reaches the crystal oscillator 301 disposed in the head cap 102. Accordingly, when the function liquid comes into contact with the crystal oscillator 301 (when the crystal oscillator 301 is immersed in the function liquid), the function liquid detection signal is sent to the control means 6 from the detection means 161. When all the passages inside the function liquid droplet ejection head are filled with the function liquid, a signal from the detection means 161 becomes as (1) in FIG. 15 ("detection" signal or "detected" signal refers to the signal issued in a state of "detected" as represented by the raised part of the horizontal line in FIG. 15). Namely, when the function liquid detection signal is transmitted to the control means 6 continuously for a predetermined period of time, it is detected that no bubbles exist in the passages inside the function liquid droplet ejection head and all the passages are filled with the function liquid. In this case, when the function liquid detection signal is sent from all the detection means 161 continuously for a second predetermined period of time (T2 in FIG. 15) within a first predetermined period of time (T1 in FIG. 15) after starting the detection operation by the detection means 161, the control means 6 outputs a stop signal. Thereafter, this stop signal is delayed by a delay circuit (delay means) to generate timing for stopping the drive of the suction means. Accordingly, the drive of the suction pump is stopped at this timing and the filling of the function liquid is terminated.

Figure 15:
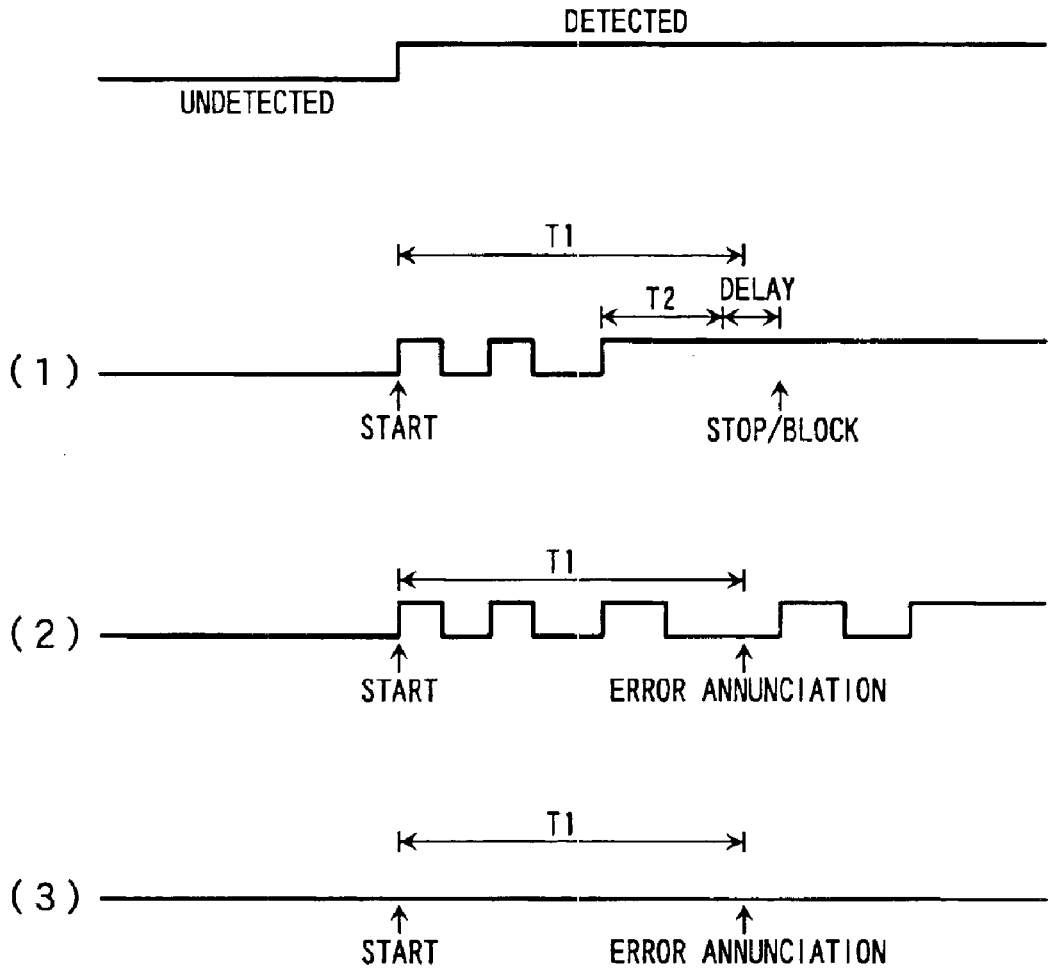
FIG. 15 is a time chart of a function liquid detection signal transmitted by detection means.

In case where bubbles exist in the passages inside the function liquid droplet ejection head, as shown in (2) of FIG. 15, the function liquid detection signal is intermittently sent to the control means 6 in accordance with a portion where the bubbles exist. Moreover, in the case of function liquid shortage where no function liquid is supplied from the function liquid tank, the passages inside the function liquid droplet ejection head run out of ink. Thus, a signal from the detection means 161 becomes as shown in (3) of FIG. 15. When the function liquid detection signal is not continuously sent for the second predetermined period of time (T2 in FIG. 15) such as the cases described above within the first predetermined period of time (T1 in FIG. 15) after starting the detection operation by the detection means 161, the control means 6 makes an annunciation indicating an error state. This annunciation is performed by display on a display unit provided in the liquid droplet ejection apparatus 1 or by voice.

Due to a difference in passage resistance in the function liquid passages, time required for filling of the function liquid may differ for each of the function liquid droplet ejection heads 31. In this case, for each of the detection means 161, a supply valve corresponding thereto is controlled to be opened and closed. Thus, it is possible to prevent unnecessary consumption of the function liquid from (the passages inside) the function liquid droplet ejection head 31 filled with the function liquid. Specifically, when the function liquid detection signal is sent from the detection means 161 continuously for the second predetermined period of time (T2 in FIG. 15) within the first predetermined period of time (T1 in FIG. 15) after starting the detection operation by the detection means 161, the control means 6 outputs a pipeline blocking signal (i.e., a signal to block the liquid passage). Thereafter, this stop signal is delayed by the delay circuit (delay means) to generate timing for blocking (closing) the suction valve. Accordingly, at this timing, only the suction valve 163 corresponding to the detection means 161 which has sent the function liquid detection signal is closed. This processing is performed for all the detection means 161. In other words, corresponding suction valves 163 are sequentially closed as the function liquid reaches each of the detection means 161. Thus, it is possible to prevent continuous suction of the function liquid by the function liquid droplet ejection head 31 filled with the function liquid. Consequently, the amount of consumption of the function liquid can be reduced.

In the first embodiment, even when the function liquid is accumulated in the head cap 102 by flushing, discharge of the function liquid can be controlled by the control means 6. Namely, the function liquid ejected toward the head cap 102 from the function liquid droplet ejection head 31 by flushing is temporarily retained by the absorber 123 housed in the head cap 102. However, the function liquid that is more than the absorber 123 can retain comes into contact with the crystal oscillator 301 disposed in the sidewall portion of the head cap 102. In this case, the control means 6 receives the function liquid detection signal of the detection means 161 and drives the suction pump 141. In other words, the function liquid accumulated in the head cap 102 is sucked to be discharged from the head cap 102. Thus, the function liquid is never solidified in the head cap 102 after being left therein for a long period of time.

Next, a second embodiment of this invention will be described. A liquid droplet ejection apparatus 7 of the second embodiment has approximately the same arrangement as that of the liquid droplet ejection apparatus 1 of the first embodiment. Here, differences between the liquid droplet ejection apparatus of the second embodiment and that of the first embodiment will be described. In each of the six supply tubes 241 extending to the function liquid droplet ejection head 31, a head side pressure sensor 245 (pressure detection means) which is connected to a pressure controller 294 to be described later is provided in the vicinity of the function liquid droplet ejection head 31. The supply tank 231 is pressurized based on the head side pressure sensor 245. In the air supply tube 292 connected to the supply tank 231, the pressure controller 294 connected to the head side pressure sensor 245 and a three-way valve 244*a* having an air releasing port are provided. The pressure controller 294 appropriately reduces the pressure of compressed air sent from the regulator 293 and sends the compressed air to the supply tank 231. In addition, the pressure controller 294 can adjust the pressure applied to the supply tank 231 by controlling the three-way valve 244*a* to be opened and closed.

Figure 14:
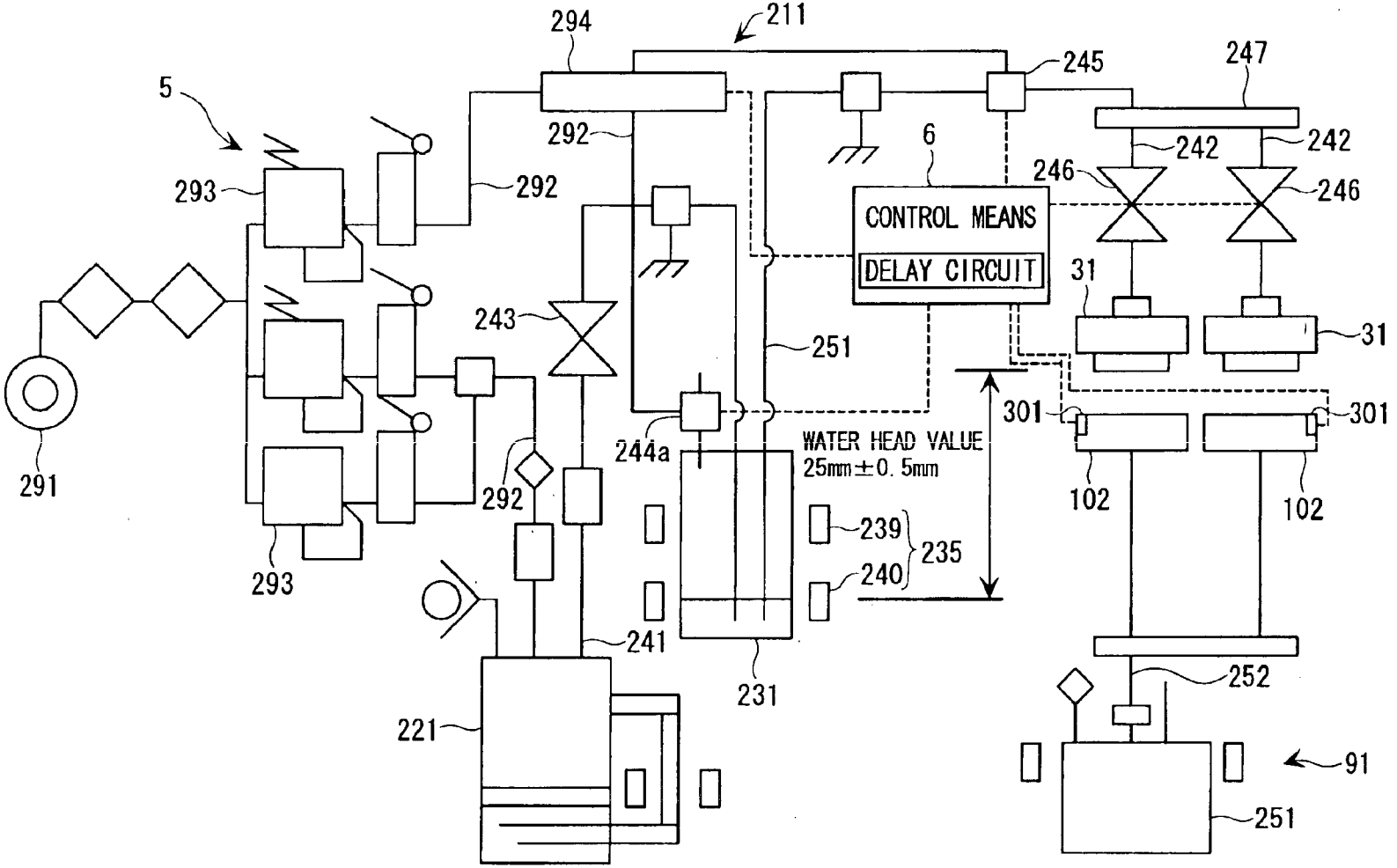
FIG. 14 is a schematic diagram, according to a second embodiment of this invention, showing a function liquid droplet ejection head, a function liquid supply system, air supply means, and a suction unit, which are connected to the function liquid droplet ejection head.

With reference to FIG. 14, first, the control means 6 moves the function liquid droplet ejection head 31 (the head unit 21) immediately above the suction unit 91. Thereafter, the lift mechanism 181 of the suction unit 91 is driven to move the head cap 102 to the first position and adhere the head cap 102 to the function liquid droplet ejection head 31. On the other hand, the control means 6 switches the three-way valve 244*a* in synchronization with the drive of the suction pump, closes the air releasing port and releases the blocked (or closed) air supply tube 292. Accordingly, the compressed air is supplied to the supply tank 231 from the air pump 291, and the inside of the supply tank 231 is pressurized.

Therefore, due to a pressure difference of the function liquid droplet ejection head 31, which is caused by the pressurization of the supply tank 231, the function liquid stored in the supply tank 231 is sent by pressurization (i.e., under pressure) toward the function liquid droplet ejection head 31. In each of the branched supply tubes 242, there is interposed a supply valve 246 for blocking (or closing) a branched supply passage. The supply valve 246 is controlled to be opened and closed by the control means 6.

When the passages inside the function liquid droplet ejection head 31 are filled with the function liquid, the function liquid reaches the crystal oscillator 301 provided in the head cap 102. Accordingly, when the function liquid comes into contact with the crystal oscillator 301, the function liquid detection signal is sent to the control means 6 from the detection means 161. When all the passages in the function liquid droplet ejection head are filled with the function liquid, a signal from the detection means 161 becomes as (1) of FIG. 15. Namely, when the function liquid detection signal is transmitted to the control means 6 continuously for a predetermined period of time, it is possible to know that no bubbles exist in the passages inside the function liquid droplet ejection head and all the passages are filled with the function liquid. In this case, when the function liquid detection signal is sent from all the detection means 161 continuously for the second predetermined period of time (T2 in FIG. 15) within the first predetermined period of time (T1 in FIG. 15) after starting the detection operation by the detection means 161, the control means 6 outputs a stop signal. Thereafter, this stop signal is delayed by the delay circuit (delay means) to generate timing for stopping the drive of the pressurization means. Accordingly, at this timing, the three-way valve 244*a* is switched to the air releasing port so that the air supply tube 292 is blocked or closed and the pressure in the supply tank 231 is released to the atmosphere. Consequently, the filling of the function liquid is terminated.

In case where bubbles exist in the passages inside the function liquid droplet ejection head, as shown in (2) of FIG. 15, the function liquid detection signal is intermittently sent to the control means 6 in accordance with a portion where the bubbles exist. Moreover, in the case of function liquid shortage where no function liquid is supplied from the function liquid tank, the passages inside the function liquid droplet ejection head run out of ink. Thus, a signal from the detection means 161 becomes as shown in (3) of FIG. 15. When the function liquid detection signal is not continuously sent for the second predetermined period of time such as the cases described above within the first predetermined period of time after starting the detection operation by the detection means 161, the control means 6 makes an annunciation indicating an error state. This annunciation is performed by display on a display unit provided in the liquid droplet ejection apparatus 7 or by voice.

Due to a difference in the flow resistances in the function liquid passages, time required for filling the function liquid may differ for each of the function liquid droplet ejection heads 31. In this case, for each of the detection means 161, a supply valve 246 corresponding thereto is controlled to be opened and closed. Thus, it is possible to prevent unnecessary consumption of the function liquid from (the passages in) the function liquid droplet ejection head 31 filled with the function liquid. Specifically, when the function liquid detection signal is sent from the detection means 161 continuously for the second predetermined period of time within the first predetermined period of time after starting the detection operation by the detection means 161, the control means 6 outputs a pipeline blocking signal (i.e., a signal to close the passage). Thereafter, this stop signal is delayed by the delay circuit (delay means) to generate timing for blocking the supply valve 246. Accordingly, at this timing, only the supply valve 246 corresponding to the detection means 161 which has sent the function liquid detection signal is closed. This processing is performed for all the detection means 161. In other words, corresponding supply valves 246 are sequentially closed as the function liquid reaches each of the detection means 161. Thus, it is possible to prevent the function liquid droplet ejection head 31 already filled with the function liquid from being kept on supplied with the function liquid. As a result, the amount of consumption of the function liquid can be reduced.

The function liquid passes only by the suction using the suction pump in the liquid droplet ejection apparatus 1 of the first embodiment and only by pressurization of the supply tank 231 in the liquid droplet ejection apparatus 7 of the second embodiment. However, the suction using the suction pump and the pressurization of the supply tank 231 may be performed in combination.

Figure 16:
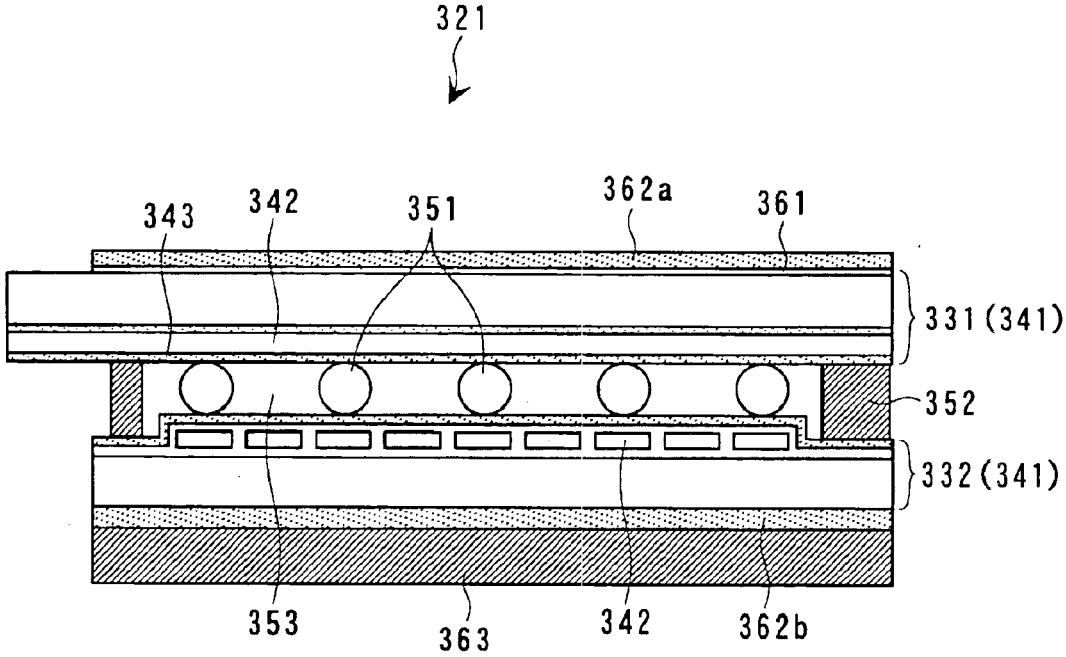
FIG. 16 is a cross-sectional view of a liquid crystal display device manufactured by using a manufacturing method according to this invention.

Here, description will be given of the case where the above-described liquid droplet ejection apparatus 1 is applied to manufacturing of a liquid crystal display device. FIG. 16 shows a cross-sectional structure of a liquid crystal display device 321. As shown in FIG. 16, the liquid crystal display device 321 is made up of: a glass substrate 341 as a main body, which includes upper and lower substrates 331 and 332 in which transparent conductive films (ITO films) 342 and orientation films 343 are formed on surfaces opposed to each other; a multiplicity of spacers 351 provided between these upper and lower substrates 331 and 332; a sealing member 352 which seals a gap between the upper and lower substrates 331 and 332; and a liquid crystal 353 filled between the upper and lower substrates 331 and 332. In addition, in the liquid crystal display device 321, a phase substrate 361 and a polarizing plate 362*a* are laminated on a back of the upper substrate 331 and a polarizing plate 362*b* and a backlight 363 are laminated on a back of the lower substrate 332.

In a normal manufacturing process, the upper and lower substrates 331 and 332 are manufactured separately from each other by performing patterning of the transparent conductive films 342 and application of the orientation films 343, respectively. Thereafter, the spacers 351 and the sealing member 352 are formed on the lower substrate 332 and, in this state, the upper substrate 331 is attached to the lower substrate 332. Next, the liquid crystal 353 is injected from an inlet of the sealing member 352 and the inlet is sealed. Thereafter, the phase substrate 361, both of the polarizing plates 362*a* and 362*b* and the backlight 363 are laminated.

The liquid droplet ejection apparatus 1 according to the embodiment can be utilized to form the spacers 351 and to inject the liquid crystal 353, for example. To be more specific, a spacer material (for example, ultraviolet curable resin or thermosetting resin) and a liquid crystal, both of which form a cell gap, are introduced as the function liquid and are evenly ejected (applied) onto predetermined positions. First, the lower substrate 332 on which the sealing member 352 is printed in a ring shape is set on the suction table 72. Thereafter, the spacer material is ejected onto the lower substrate 332 at rough intervals and the spacer material is solidified by ultraviolet irradiation. Next, a predetermined amount of the liquid crystal 353 is evenly ejected and injected into the sealing member 352 of the lower substrate 332. Thereafter, the separately prepared upper substrate 331 and the lower substrate 332 having the predetermined amount of liquid crystal applied thereon are introduced to a vacuum and attached to each other.

As described above, before the upper and lower substrates 331 and 332 are attached or adhered to each other, the liquid crystal 353 is evenly applied (filled) in the cell. Thus, it is possible to resolve a problem in that the liquid crystal 353 is not distributed to narrow portions such as corners of the cell, and the like.

By using the ultraviolet curable resin or the thermosetting resin as the function liquid (the material for the sealing member), printing of the above-described sealing member 352 can be also performed by using this liquid droplet ejection apparatus 1. Similarly, by introducing polyimide resin as the function liquid (an orientation film material), the orientation films 343 can be also manufactured by using the liquid droplet ejection apparatus 1.

As described above, when the liquid crystal display device 321 is manufactured by using the liquid droplet ejection apparatus 1, a flow rate of the function liquid in the function liquid passages is increased in filling the function liquid. Thus, bubbles can be efficiently discharged from the function liquid passages (the passages inside the function liquid droplet ejection head). Consequently, the amount of the function liquid consumed in filling the function liquid can be reduced and the liquid crystal display device 321 can be efficiently manufactured.

The liquid droplet ejection apparatus 1 arranged as described above can be used to manufacture various electro-optical devices other than the above-described liquid crystal display device 321 which is mounted in electronic equipment such as a portable telephone and a personal computer. Namely, the liquid droplet ejection apparatus 1 can be applied to the manufacturing of an organic EL device, an FED device, a POP device, an electrophoretic display device and the like.

Figure 17:
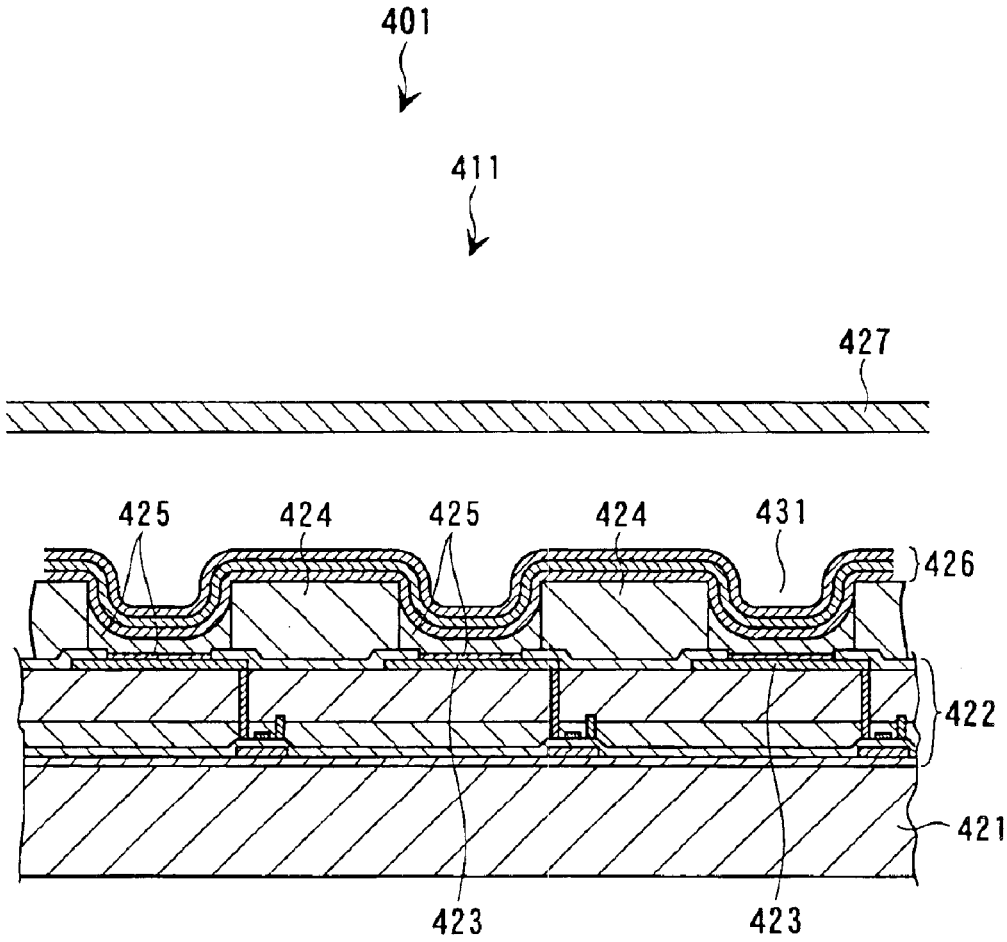
FIG. 17 is a cross-sectional view of an organic EL device manufactured by using a manufacturing method according to this invention.

Here, brief description will be given of an example of applying the above-described liquid droplet ejection apparatus 1 to the manufacturing of the organic EL device. As shown in FIG. 17, in an organic EL device 401, wiring of a flexible substrate (not illustrated) and a drive integrated circuit (IC, not illustrated) are connected to an organic EL element 411. Specifically, the organic EL element 411 is made up of a substrate 421, a circuit element part 422, pixel electrodes 423, bank parts 424, light-emitting elements 425, a cathode 426 (a counter electrode) and a sealing substrate 427. The circuit element part 422 is formed on the substrate 421 and a plurality of pixel electrodes 423 are arranged on the circuit element part 422. Between the respective pixel electrodes 423, the bank parts 424 are formed in a lattice pattern. In concave sections 431 formed by the bank parts 424, the light-emitting elements 425 are formed. The cathode 426 is formed all over the bank parts 424 and the light-emitting elements 425. Above the cathode 426, the sealing substrate 427 is laminated.

In a manufacturing process of the organic EL device 401, the bank parts 424 are formed at predetermined positions on the substrate 421 (the workpiece W) on which the circuit element part 422 and the pixel electrodes 423 are formed in advance. Thereafter, plasma processing is performed for properly forming the light-emitting elements 425. Subsequently, the light-emitting elements 425 and the cathode 426 (the counter electrode) are formed. Thereafter, the sealing substrate 427 is laminated on the cathode 426 for sealing and the organic EL element 411 is obtained. Subsequently, the cathode 426 of the organic EL element 411 is connected to the wiring of the flexible substrate and wiring of the circuit element part 422 is connected to the drive IC. Thus, the organic EL device 401 is manufactured.

The liquid droplet ejection apparatus 1 is used to form the light-emitting elements 425. To be more specific, a light-emitting element material (a function liquid) is introduced to the function liquid droplet ejection head 31. Thereafter, the light-emitting element material is ejected in accordance with positions of the pixel electrodes 423 of the substrate 421 on which the bank parts 424 are formed. Subsequently, the light-emitting element material is dried. Thus, the light-emitting elements 425 are formed. Note that, also in formation of the above-described pixel electrodes 423 and cathode 426 and the like, by using respective liquid materials corresponding thereto, those components can be also formed by using the liquid droplet ejection apparatus 1.

Moreover, as other electro-optical devices, devices for forming a metallic wiring, a lens, a resist, a light diffusion body and the like are conceivable. By using the foregoing liquid droplet ejection apparatus 1 for manufacturing various electro-optical devices, the consumption of the function liquid in filling thereof can be reduced. Thus, manufacturing costs can be reduced.

As described above, according to the liquid droplet ejection apparatus of this invention, when the passages in the function liquid droplet ejection heads are filled with the function liquid, it is detected that the function liquid reaches the cap by using the detection means including the crystal oscillator. Thus, the passages inside the function liquid droplet ejection head can be surely filled with the function liquid and unnecessary consumption of the function liquid in filling thereof can be reduced to a minimum.

Moreover, the foregoing liquid droplet ejection apparatus is applied to the method of manufacturing an electro-optical device of this invention and is used to manufacture the electro-optical device and the electronic equipment according to this invention. Thus, the function liquid can be properly filled and efficient manufacturing is made possible. Moreover, the amount of the function liquid required to fill the function liquid droplet ejection head can be reduced. Thus, the manufacturing costs can be reduced.

What is claimed is:

1. A function liquid filling apparatus which fills a passage inside a function liquid droplet ejection head connected to a function liquid tank with a function liquid in said function liquid tank by coupling a head cap connected to a waste liquid passage to said function liquid droplet ejection head, thereby feeding the function liquid toward said head cap through said function liquid droplet ejection head, said apparatus comprising:

feed means for feeding the function liquid in the function liquid tank toward said head cap through said function liquid droplet ejection head;

detection means for detecting a state in that the fed function liquid reaches said head cap; and control means for stopping drive of said feed means based on a result of detection by said detection means, wherein said detection means comprises a crystal oscillator disposed in at least one of inside said head cap and inside said waste liquid passage, and a detector for detecting presence or absence of the function liquid based on a change in a resonance frequency of said crystal oscillator.

2. The function liquid filling apparatus according to claim 1, wherein said control means stops the drive of said feed means when a "detected" signal of said detector lasts for a predetermined period of time after a detection operation by said detection means is started.

3. The function liquid filling apparatus according to claim 2, wherein said control means includes delay means for delaying output of a stop signal which stops the drive of said feed means for a predetermined period of time.

4. The function liquid filling apparatus according to claim 1, wherein said control means includes annunciation means for making an annunciation when a "detected" signal of said detector fails to continue for a predetermined period of time after a detection operation by said detection means is started.

5. The function liquid filling apparatus according to claim 1, wherein said feed means is pressurization feed means which is connected to said function liquid tank and which feeds the function liquid in said function liquid tank by pressurization.

6. The function liquid filling apparatus according to claim 1, wherein said feed means is suction means for sucking the function liquid in said function liquid tank through said waste liquid passage.

7. A function liquid filling apparatus which fills a plurality of passages inside a plurality of function liquid droplet ejection heads each being respectively connected to a function liquid tank through a plurality of supply passages, with a function liquid in said function liquid tank by coupling a plurality of head caps each being respectively connected to a plurality of waste liquid passages to said function liquid droplet ejection heads, thereby feeding the function liquid toward said plurality of head caps through said plurality of function liquid droplet ejection heads, said apparatus comprising:

pressurization feed means which is connected to said function liquid tank and which feeds under pressure the function liquid in said function liquid tank;

a plurality of passage blocking means each being respectively interposed in said plurality of supply passages;

a plurality of detection means for respectively detecting a state in that the fed function liquid reaches said plurality of head caps; and control means for causing said passage blocking means corresponding to the head caps to which the function liquid has reached, to perform blocking operation in an order of reaching of the function liquid, based on a result of detection by said plurality of detection means, wherein each of said detection means comprises a crystal oscillator disposed in at least one of inside said head cap and inside said waste liquid passage, and a detector for detecting presence or absence of the function liquid based on a change in a resonance frequency of said crystal oscillator.

8. A function liquid filling apparatus which fills passages in a plurality of function liquid droplet ejection heads connected to a function liquid tank through a plurality of supply passages, with a function liquid in said function liquid tank by coupling a plurality of head caps each being respectively connected to a plurality of waste liquid passages to said function liquid droplet ejection heads and by sucking the function liquid toward said plurality of head caps through said plurality of function liquid droplet ejection heads, said apparatus comprising:

suction means for sucking the function liquid in said function liquid tank through said waste liquid passages;

a plurality of passage blocking means each being respectively interposed in said plurality of waste liquid passages;

a plurality of detection means for detecting a state in that the fed function liquid reaches said plurality of head caps; and control means for causing said passage blocking means corresponding to the head caps to which the function liquid has reached, to perform blocking operation in an order of reaching of the function liquid, based on a result of detection by said plurality of detection means, wherein each of said detection means comprises a crystal oscillator disposed in at least one of inside said head cap and inside said waste liquid passage, and a detector for detecting presence or absence of the function liquid based on a change in a resonance frequency of said crystal oscillator.

9. The function liquid filling apparatus according to claim 7, wherein said control means causes each of said passage blocking means to perform the blocking operation when a "detected" signal by said detector continues for a predetermined period of time after a detection operation by each of said detection means is started.

10. The function liquid filling apparatus according to claim 8, wherein said control means causes each of said passage blocking means to perform the blocking operation when a "detected" signal of said detector continues for a predetermined period of time after a detection operation by each of said detection means is started.

11. The function liquid filling apparatus according to claim 9, wherein said control means comprises delay means for delaying, for a predetermined period of time, output of a blocking signal which allows each of said duct blocking means to perform the blocking operation.

12. The function liquid filling apparatus according to claim 10, wherein said control means comprises delay means for delaying, for a predetermined period of time, output of a blocking signal which allows each of said duct blocking means to perform the blocking operation.

13. The function liquid filling apparatus according to claim 7, wherein said control means comprises annunciation means for making an annunciation when a "detected" signal of said detector fails to continue for a predetermined period of time after a detection operation by said detection means is started.

14. The function liquid filling apparatus according to claim 1, further comprising cleaning liquid supply means which is connected to said function liquid tank and which cleans all flow passages of the function liquid by feeding a cleaning liquid to all said flow passages from said function liquid tank to said waste liquid passages.

15. A liquid droplet ejection apparatus comprising:

the function liquid filling apparatus according to claim 1; and a drawing device which forms a film formation part with the function liquid on a workpiece by ejecting the function liquid droplet while making a relative movement between said function liquid droplet ejection head and the workpiece.

16. A method of manufacturing an electro-optical device, comprising forming a film formation part on a workpiece with the function liquid droplet by means of the function liquid droplet ejection apparatus according to claim 15.

17. An electro-optical device in which a film formation part is formed on a workpiece with a function liquid droplet by means of the function liquid droplet ejection apparatus according to claim 15.

18. An electronic equipment manufactured by the method of manufacturing the electro-optical device according to claim 16.

19. An electronic equipment having mounted thereon the electro-optical device according to claim 17.

20. The function liquid filling apparatus according to claim 8, wherein said control means comprises annunciation means for making an annunciation when a "detected" signal of said detector fails to continue for a predetermined period of time after a detection operation by said detection means is started.

* * * * *